US008848489B2

(12) United States Patent
Suzuki

(10) Patent No.: US 8,848,489 B2
(45) Date of Patent: Sep. 30, 2014

(54) CALENDAR MECHANISM AND TIMEPIECE HAVING THE SAME

(71) Applicant: Seiko Instruments Inc., Chiba (JP)

(72) Inventor: Shigeo Suzuki, Chiba (JP)

(73) Assignee: Seiko Instruments Inc. (JP)

( * ) Notice: Subject to any disclaimer, the term of this patent is extended or adjusted under 35 U.S.C. 154(b) by 114 days.

(21) Appl. No.: 13/688,339

(22) Filed: Nov. 29, 2012

(65) Prior Publication Data

US 2013/0170325 A1 Jul. 4, 2013

(30) Foreign Application Priority Data

Dec. 1, 2011 (JP) ..... 2011-263935

(51) Int. Cl.
*G04B 19/20* (2006.01)
*G04B 19/24* (2006.01)
*G04B 19/253* (2006.01)

(52) U.S. Cl.
CPC ..... *G04B 19/253* (2013.01); *G04B 19/2536* (2013.01)
USPC ..... 368/37; 368/35

(58) Field of Classification Search
USPC ..... 368/28; 257/31–38
See application file for complete search history.

(56) References Cited

U.S. PATENT DOCUMENTS

| | | | | | |
|---|---|---|---|---|---|
| 203,640 | A * | 5/1878 | Paddock | ..... | 368/31 |
| 3,716,983 | A * | 2/1973 | Tanaka et al. | ..... | 368/28 |
| 3,841,084 | A * | 10/1974 | Eumier | ..... | 368/37 |
| 6,108,278 | A * | 8/2000 | Rochat | ..... | 368/28 |
| 7,218,576 | B1 * | 5/2007 | Bron | ..... | 368/35 |
| 7,242,640 | B2 | 7/2007 | Fleury | ..... | 368/38 |
| 8,059,492 | B2 | 11/2011 | Watanabe | ..... | 368/37 |
| 2010/0188937 | A1 * | 7/2010 | Watanabe | ..... | 368/37 |

FOREIGN PATENT DOCUMENTS

JP 63 313089 12/1988

* cited by examiner

*Primary Examiner* — Sean Kayes
(74) *Attorney, Agent, or Firm* — Adams & Wilks

(57) ABSTRACT

A calendar mechanism of a timepiece includes a month cam having a cam surface distinguishing between a long month (31 days) and a short month (30 days or less) and makes one rotation a year. A date indicator driving wheel has a date finger that makes one rotation every 24 hours and engages with a date wheel of a date indicator to rotate the date indicator. An operating lever structure has a proximal portion friction-engaged with an offset shaft to rotate around the offset shaft offset with respect to the rotation center of the date indicator driving wheel. The operating lever structure has a first distal end portion engaged with the month cam and a second distal end portion engaged with a month end tooth of the date indicator to effect additional date feeding by one day with respect to the date indicator at the end of a short month.

8 Claims, 24 Drawing Sheets

Fig. 11
00:32
(a)
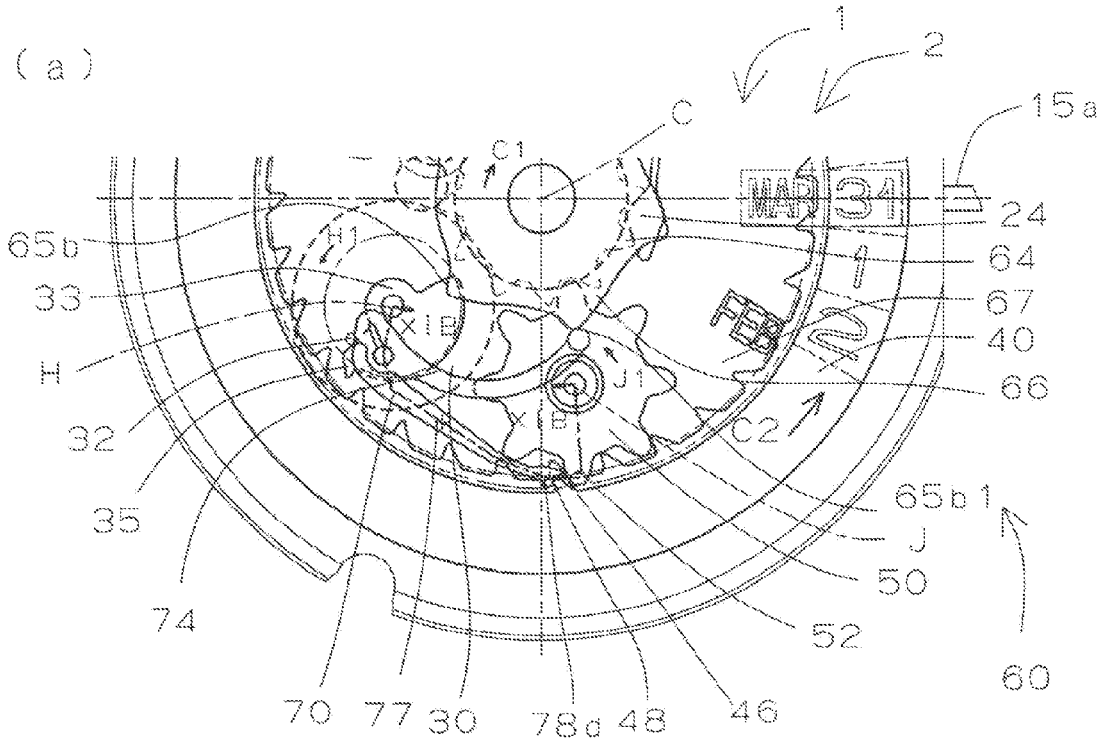
(b)
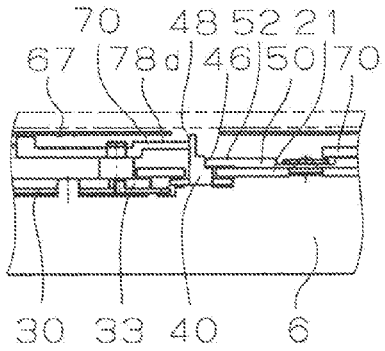

CALENDAR MECHANISM AND TIMEPIECE HAVING THE SAME

BACKGROUND OF THE INVENTION

1. Field of the Invention

The present invention relates to a calendar mechanism, and a timepiece having the same.

2. Description of the Related Art

Regarding a calendar mechanism, various techniques are known as techniques for forming a so-called auto calendar mechanism which per forme month feeding for a longer month (a month which has 31 days and which is also referred to as a long month in this specification) and for a shorter month (a month which has not more than 30 days and which is also referred to as a short month in this specification) in different manners.

In an auto calendar mechanism, from the month end ($30^{th}$ day) of a shorter month other than February to the first day of a longer month, date feeding is effected by extra one day as an additional date feeding to perform date feeding by two days; in this connection, various mechanisms have been proposed; in particular, there has been proposed provision of a data indicator driving wheel with a paw structure adapted to rotate a date indicator separately from a date feeding finger so that additional date feeding can be effected at the end of a shorter month (JP-A-2009-128119 (Patent Document 1)).

In the calendar mechanism according to Patent Document 1, to perform additional date feeding on the date indicator at the end of a short month, a rigid finger is provided so as to be capable of translation with respect to the rotation shaft of the date indicator driving wheel as a short month end feeding finger structure operated by a month cam, generating a translation operation by the month cam in a short month and causing it to be engaged with the month end feeding tooth of the date indicator at the month end through the translation.

However, in this case, positional control in the radial direction of the date indicator driving wheel is to be performed on the rigid finger, so that the rigid finger constituting the month end feeding finger structure is retained so as to be capable of translation in the radial direction of the date indicator driving wheel within, the range of the diameter of the date indicator driving wheel with respect to the rotation center of the date indicator driving wheel, and is caused to translate in the radial direction by the month cam in a short month, which means a request for a rather complicated structure and for high dimensional precision is inevitable for the space that can be occupied by the finger structure support structure and the month cam structure.

A technique is also known according to which the position of the engagement portion of the date feeding finger is changed so that, additional date feeding can be effected between the end of a shorter month and the start of a longer month (Japanese Patent No. 2651150 (Patent Document 2)).

However, in the calendar mechanism according to Patent Document 2; an elastic arm portion of the date feeding finger is usually forcibly deformed (on days other than shorter month ends) to feed solely one tooth a day, so that the roughness load (the load applied to the rotation of the train wheel) is structurally likely to increase, which is likely to involve energy loss.

Various proposals have been made regarding the provision of a date wheel rotating mechanism separately from the date feeding finger so that additional date feeding can be effected from the end of a shorter month to the start of a longer couth (See, for example, JP-A-2005-326420 (Patent Document 3)).

However, in the calendar mechanism, for example, of Patent Document 3, there is employed a planetary gear mechanism with a predetermined number of teeth so that a predetermined operation can be performed, which means it is rather difficult to avoid, a very complicated structure.

SUMMARY OF THE INVENTION

The present invention has been made in view of the above problems; it is an object, of the present invention to provide a calendar mechanism of a novel structure capable of avoiding an excessive frictional load while avoiding an excessively complicated structure, and a timepiece having the same.

To achieve the above object, according to the present invention, there is provided a calendar mechanism comprising: a month cam equipped with a cam surface distinguishing between a long month having 31 days and a short month having 30 days or less and adapted to make one rotation a year; a date indicator equipped with a date wheel and a month end tooth; a date indicator driving wheel equipped with a date finger adapted to make one rotation every 24 hours and engaged with the date wheel of the date indicator to rotate the date indicator; and an operating lever structure whose proximal portion is friction-engaged with an offset shaft so as to be capable of rotating around the offset shaft offset with respect to the rotation center of the date indicator driving wheel and which is equipped with a first distal end portion constituting a cam follower engaged with the month cam and a second distal end portion constituting a short month end feeding finger engaged with the month end tooth of the date indicator to effect additional date feeding by one day with respect to the date indicator at the end of a short month.

In the calendar mechanism according to the present invention, "the proximal portion of the operating lever structure is friction-engaged with an offset shaft so as to be capable of rotating around the offset shaft offset with respect to the rotation center of the date indicator driving wheel," so that the operating lever structure rotates together with the date indicator driving wheel; "the operating lever structure is equipped with a first distal end portion constituting a cam follower engaged with the month cam," so that the cam follower is pressed against the month cam when the operating lever structure rotates together with the date indicator driving wheel; "the proximal portion of the operating lever structure is friction-engaged with the offset shaft of the date indicator driving wheel," so that when the cam follower is pressed against the month cam, the operating lever structure makes relative rotation with respect to the offset shaft; "the operating lever structure is equipped with a second distal end portion constituting a short month end feeding finger engaged with the month end tooth of the date indicator to effect additional date feeding by one day with respect to the date indicator at the end of a short month," so that, at the end of a short month, the proximal portion of the operating lever structure whose proximal portion is friction-engaged with the offset, shaft and whose first distal end portion constituting a cam follower is pressed against the month cam, makes relative rotation with respect to the offset shaft under the control of the month cam, and, while doing so, the second distal end portion thereof constituting a short mouth end feeding finger is engaged with the month end tooth of the date indicator to perform additional date feeding by one tooth with respect to the date indicator. In other words, in the calendar mechanism according to the present invention, at the end of a long month, the month cam sets in position or displaces the operating lever structure via the cam follower of the operating lever structure in order to relieve the short month end feeding finger so that the second distal end portion in the form of a short month end feeding finger of the operating lever structure may not be engaged with the month end tooth of the date indicator. That is, in the calendar mechanism according to the present invention, it is only necessary to provide the date indicator driving wheel with the operating lever structure and to perform, additional date feeding by one day with respect to the date indicator at the end of a short month, so that it is possible to avoid an excessively complicated structure; further, it is only necessary for the irrational load between the operating lever structure and the offset shaft to be large enough to cause the operating lever structure to rotate together with the date indicator driving wheel, so that it is possible to prevent the frictional load from being increased to an excessive degree. While, typically, the month cam makes one rotation a year, it may also make one rotation in a plurality of years if it is so desired.

Typically, in the calendar mechanism according to the present invention, the date indicator driving wheel is equipped with a disc-like date indicator driving wheel main body soap see to make one rotation every 24 hours, a date pin provided so as to be erected at the offset position of the date indicator driving wheel main body, and a date finger provided coaxially with respect to the date indicator driving wheel main body so as to be capable of making relative rotation with respect to the date indicator driving wheel main body and adapted to be rotated by the date pin, with the date finger being equipped with the offset shaft friction-engaged with the proximal portion of the operating lever structure.

In this case, the date finger is actually formed as a rigid member, and the proximal portion of the operating lever structure is friction-engaged with the offset shaft of the date finger. However, if so desired, it is also possible to erect the offset shaft on the date indicator driving wheel main body portion itself, and to friction-engage the proximal portion of the operating lever structure with the offset shaft.

Typically, in the calendar mechanism according to the present invention, the operating lever structure is integrally equipped with a first lever portion connecting the proximal portion and the first distal end portion, and a second lever portion connecting the proximal, portion, and the second distal end portion. In this case, the first lever portion and the second lever portion can be formed as elastic lever portions (arm portions) capable of elastic deformation. However, if so desired, the first and second distal end portions may also be formed by two different end edge portions of a single flat-plate-like portion. In the case where the first and second lever portions capable of deformation are provided, the short month end feeding finger of the second distal end portion is typically equipped with a recess at the distal end surface so that it can be easily engaged with the month end tooth of the date indicator, and the second lever portion is termed such that its side surface in close proximity to the month end tooth assumes an outwardly convex configuration so that the second lever portion can easily undergo elastic deformation.

In the calendar mechanism according to the present invention, the second lever portion is typically capable of elastic deformation, and the month end tooth causes the second lever portion to undergo elastic deformation with the jump control of the date indicator at the end of a snort month, thus leaving behind the distal end portion of the second lever portion.

In this case, at the time of jump control of the date indicator at the end of a short month, that is, at the time of completion of the jump control of the data jumper at the end of normal date feeding at the end of a short month, the month end tooth causes the second lever portion to undergo elastic deformation to enable it to be situated so as to leave behind the distal end portion of the second lever portion. The month end tooth at the leave-behind position is again engaged with the distal end portion (the second distal end portion) of the second lever portion in several hours, thus making it possible to effect additional date feeding by the second distal end portion.

In the calendar mechanism according to the present invention, the first distal end portion typically consists of a pin-like cam follower portion erected at the distal end of the first lever portion; the pin-like cam follower portion abuts the cam surface of the month cam; and the month cam consists of a plate-like member, with the portion of the first lever portion other than the pin-like cam follower portion being capable of overlapping the month cam in the form of a plate-like member in a non-interference state.

In this case, the rotation center of the date indicator driving wheel cent assume a position in close proximity to the outer peripheral surface of the month cam, making it possible to minimize the size in plan view. However, if so desired, the first distal end portion can be situated substantially in the same plane as the first lever portion.

Typically, in the calendar mechanism according to the present invention, the month end tooth of the date indicator and the month feeding tooth engaged with a month feeding intermediate wheel rotating a month star concentric with the month cam to rotate the month feeding intermediate wheel, are provided at the same position or positions in close proximity to each other as seen in the peripheral direction of the date indicator.

In this case, it is possible to minimise the occupation space. In this case, there are typically provided the month end tooth and the month feeding tooth at difference positions of the date indicator in the thickness direction. However, if so desired, the month end tooth and the month feeding tooth may also be formed at positions spaced away from each other in the peripheral direction.

Typically, in the calendar mechanism according to the present invention, the cam surface of the month cam is continuous and is curved smoothly over the entire area thereof.

In this case, the degree of freedom in terms of the movement of the portion constituting the cam follower can be maximised, and it is possible to suppress the site in plan view of the mechanism to a minimum degree.

To achieve the above object, the timepiece according to the present invention has a calendar mechanism as described above.

BRIEF DESCRIPTION OF THE DRAWINGS

FIG. 11 is an enlarged view of a part of FIG. 10, of which portion (a) is a partial enlarged plan explanatory view, and portion (b) is an explanatory sectional view taken along the line XIB-XIB of portion (a).

FIG. 12 is an explanatory plan view of the calendar mechanism of FIG. 1 showing it as indicating around 43 minutes past twelve o'clock a.m. on May 1 (in the state in which month feeding is started at the end of a short, month).

DETAILED DESCRIPTION OF THE PREFERRED EMBODIMENTS

A preferred mode for carrying out the present invention will be described based on a preferred example shown in the attached drawings.

Embodiment

FIGS. 1 through 24 show a timepiece 2 equipped with an auto calendar mechanism 1 as a calendar mechanism according to a preferred embodiment of the present invention.

Figure 1:
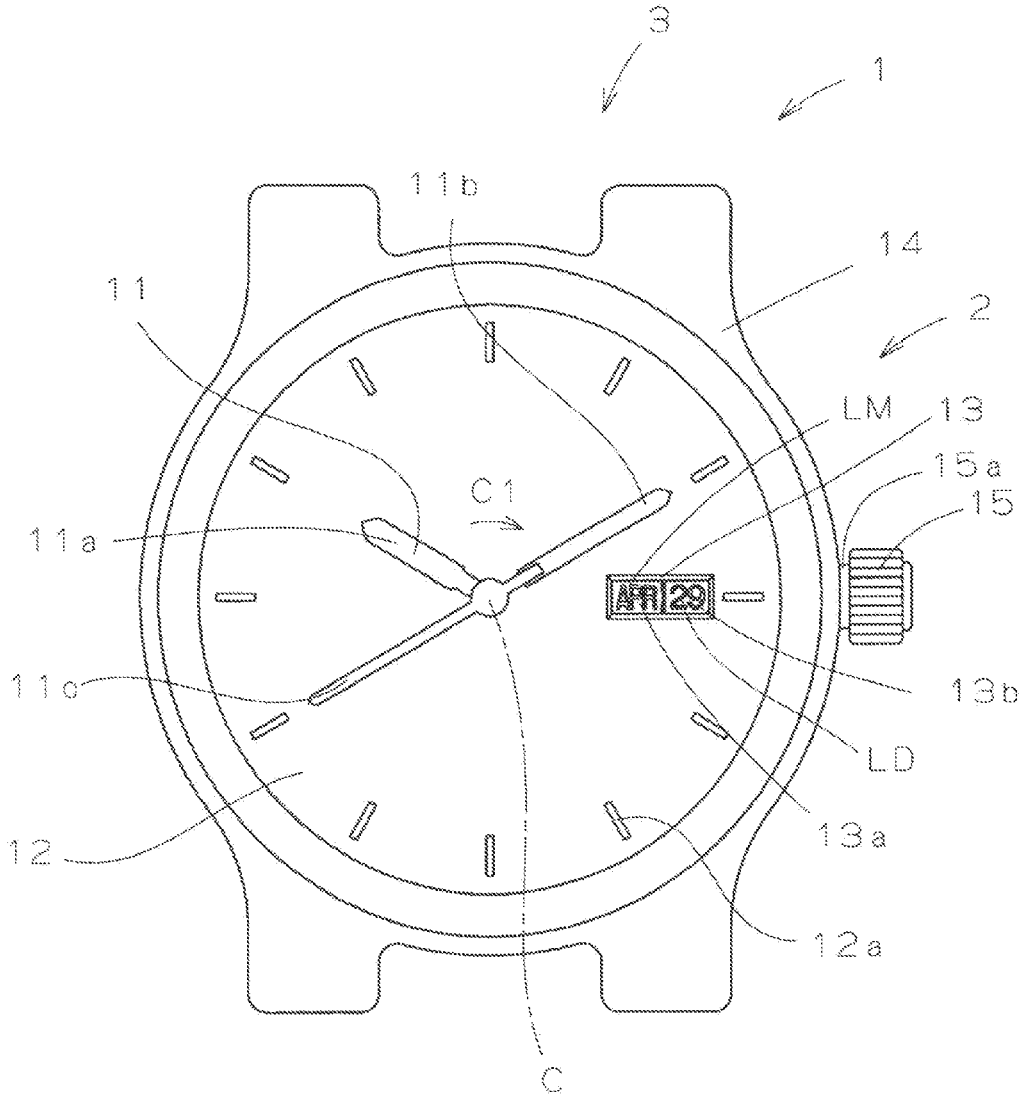
FIG. 1 is an outward explanatory view, as seen from the dial side, of a timepiece according to a preferred embodiment of the present invention equipped with a calendar mechanism according to a preferred embodiment of the present invention.

The timepiece 2 has an outward appearance 3 as shown in FIG. 1. That is, the timepiece 2 is equipped with time indicating hands 11 consisting of an hour hand 11*a*, a minute hand 11*b*, and a second hand 11*c*, which are rotatable clockwise C1 around a center axis C. A dial 12 of the timepiece 2 has set characters 12*a* indicating time positions, and a month/date display window 13 equipped with a month indicating area 13*a* and a date indicating area 13*b*. Numeral 14 indicates a timepiece case, and numeral 15 indicates a crown mounted to a winding stem 15*a*.

Figure 3:
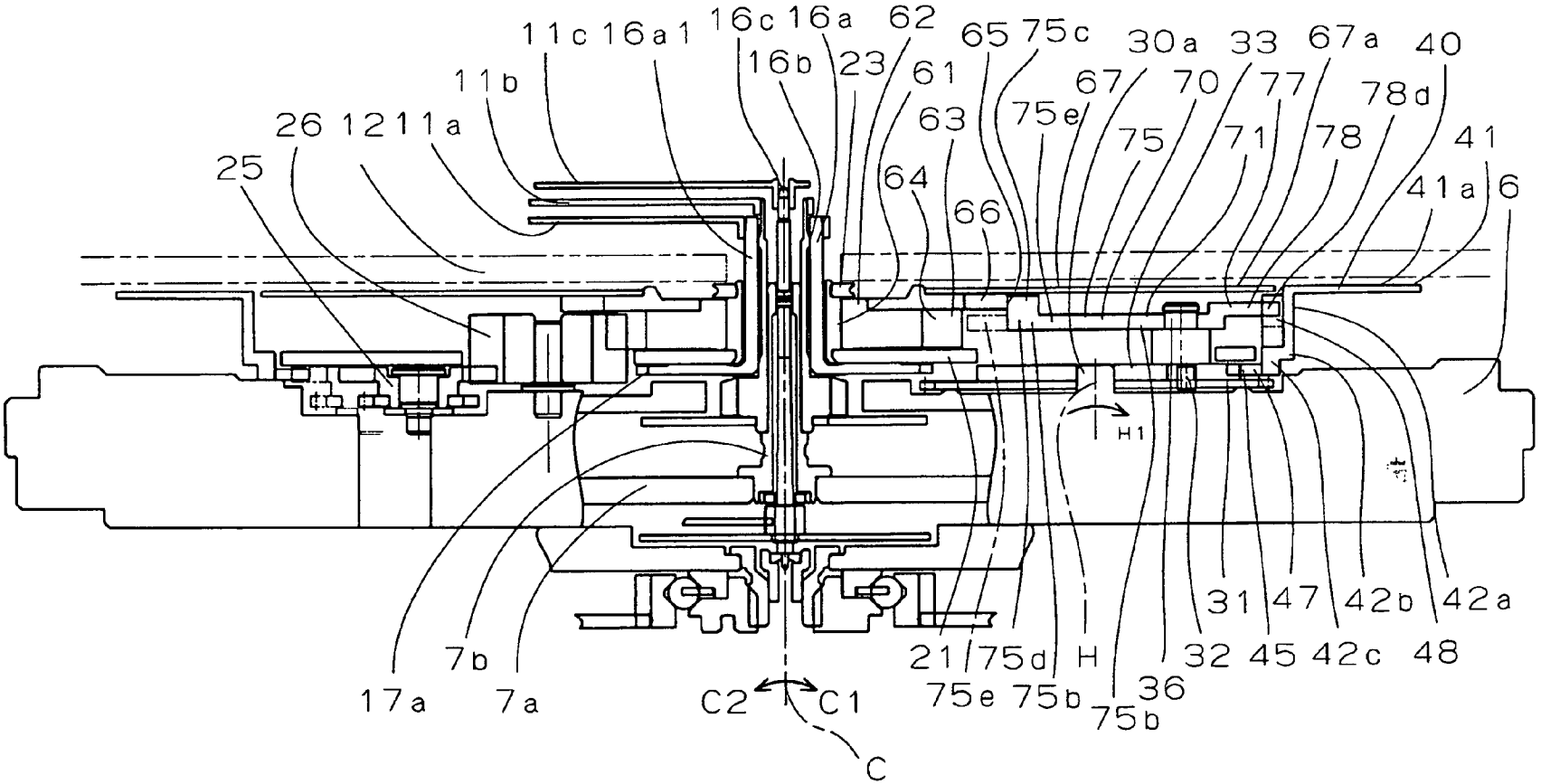
FIG. 3 is an explanatory sectional view of a part of the timepiece of FIG. 2.
Figure 4:
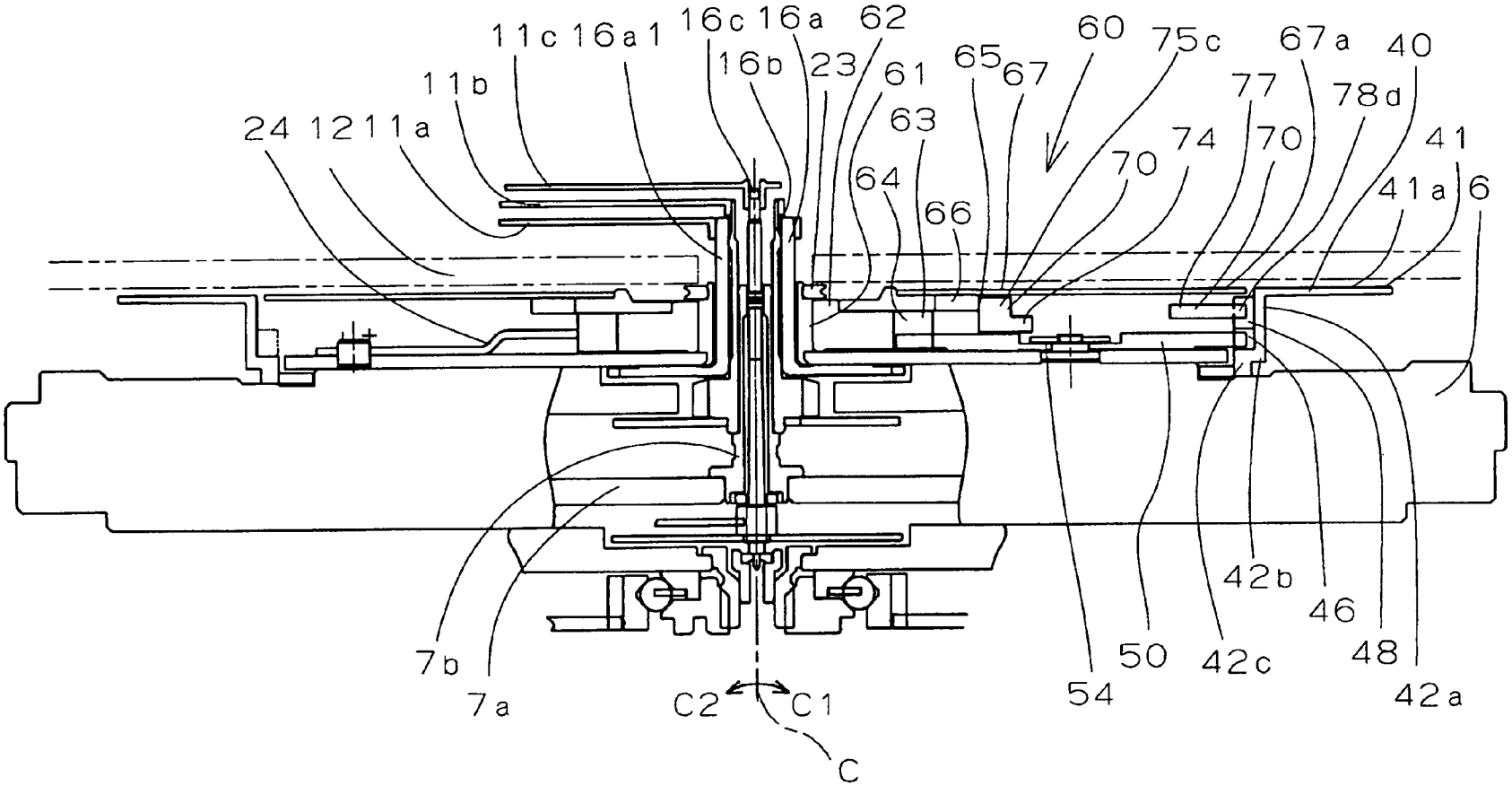
FIG. 4 is an explanatory sectional view of another part of the timepiece of FIG. 2.

In the example shown in the sectional views of FIGS. 3 and 4, an hour wheel 16*a* to the forward end of which the hour hand 11*a* is mounted, a minute wheel 16*b* to the forward end of which the minute hand 11*b* is mounted, and a second wheel a pinion 16*c* to the forward end of which the second hand 11*c* are mounted, are supported so as to foe rotatable around the center axis C via a center pipe 7*b* supported, by a main plate 6 and a center wheel bridge 7*a*, and are rotated by a hand driving train wheel connecting to each other a gear portion or hour gear of the hour wheel 16*a*, a minute gear wheel or center wheel of the minute wheel 16*b*, and a gear portion or second wheel of the second wheel & pinion 16*c*, and including another train wheel connecting to a drive source (not shown) such as a barrel drum equipped with a timepiece mainspring.

Figure 2:
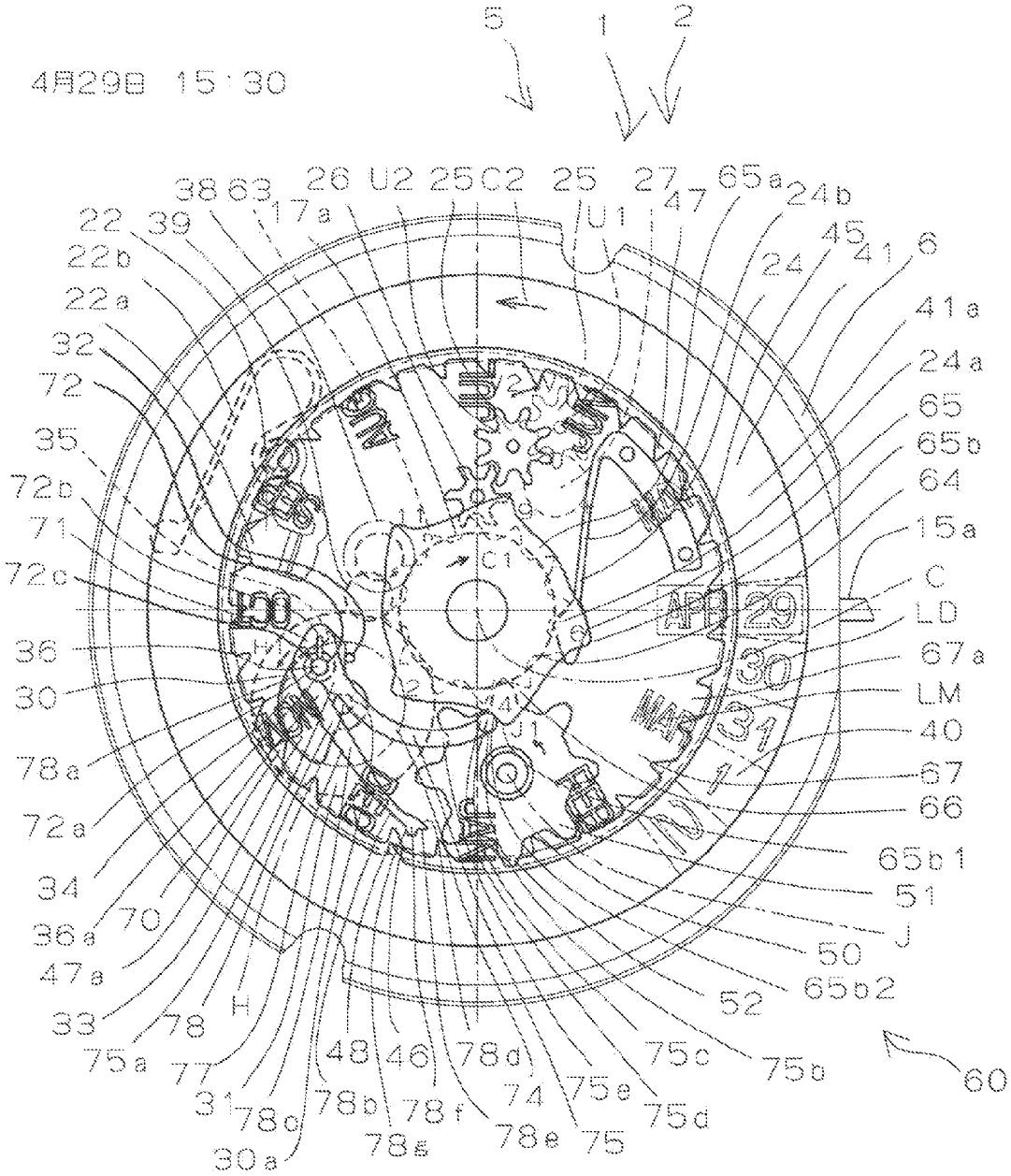
FIG. 2 is an explanatory plan view of the calendar mechanism of FIG. 1 showing it as indicating around 30 minutes past 3 o'clock p.m. on April 29.

As shown in FIGS. 2 and 3, a date indicator driving wheel 30 in mesh with an hour gear 17*a* of the hour wheel 16*a* via intermediate date wheels 38 and 39 is rotated in the direction H1 around a center axis H at a speed of one rotation per day. A date finger 32 is erected at a position (offset position) of the date gear portion 31 as the date indicator driving wheel main body portion radially spaced away from the center axis H1. A date finger 33 is fit-engaged with a rotation center shaft 30*a* of the date indicator driving wheel 30 so as to be rotatable around the shaft 30*a*. The date finger 33 consists of a base body portion 34 and a date finger main body portion 35 protruding from the base body portion 34; when the base body portion 34 is rotated by the date pin 32, the date finger main body portion 35 is engaged with the teeth of a date indicator to effect date feeding. An offset pin or offset rotation center shaft 36 as the offset shaft is integrally erected at a position of the base body portion 34 of the date finger 33 offset and spaced away from the rotation center shaft 30*a*.

As can be seen from FIGS. 2, 3, and 4 as well as portions (a) and (b) of FIG. 11 illustrated below, a date indicator 40 has a date display wheel portion 41 in the form of a large diameter annular plate, a large diameter cylindrical portion 42*a* extending axially and in parallel from the inner edge of the date display wheel portion 41, a small width thick-walled flange-like portion 42*b* extending radially inwards from the lower end of the large diameter cylindrical portion 42*a*, a small diameter thick-wailed cylindrical portion 42*c* extending axially and in parallel from the inner edge of the flange-like portion 42*b*, a date gear portion 45 formed at the inner peripheral edge on the lower end side of the small diameter thick-walled cylindrical portion 42*c*, a month finger portion or month feeding tooth portion 46 formed at the upper edge of the thick-walled flange-like portion 42*b* formed at the lower portion of the inner peripheral edge of the large diameter cylindrical portion 42*a*, and a short month end feeding tooth portion 48 as a month end tooth formed at the upper portion of the inner peripheral edge of the large diameter cylindrical portion 42*a*. Here, the short month end feeding tooth portion 48 and the month feeding tooth portion 48 are at substantially the same position as seen in the peripheral direction of the date indicator 40. However, if so desired, the short month end feeding tooth portion 48 and the month feeding tooth portion 46 may be at different positrons as seen in the peripheral direction of the date indicator 40 or positions spaced away from each other in the peripheral direction. Unless otherwise specified, in the portions of this specification referring to FIGS. 3, 4, and FIG. 11(*b*), the "upper" side refers to the side where the time indicating hands 11 exist (the dial 12 side).

On the dial side surface 41*a* of the date display wheel portion 41, there are displayed at equal intervals characters LD indicating the 31 dates of 1 through 31. The date gear portion 45 is equipped with 31 tooth portions 47 arranged at equal intervals. The rotation of the date indicator 40 in the direction C2 is set by a date jumper 22 equipped with a date jump control finger portion 22*a* and a date jump control spring portion 22*b*. As can be seen from FIGS. 3 and 4, positional deviation in the thickness direction of the date indicator 40 is set by a date indicator maintaining plate 21 mounted to the main plats 6 so as to cover the date gear portion 45.

The month finger portion or month feeding tooth portion 46 of the date indicator 40 rotates a month indicator 60 in the direction C1 around the center axis C via a month indicator driving wheel or month transmission wheel 50 as the month feeding intermediate wheel.

As can be seen from FIG. 2, the month feeding intermediate wheel 50 consists of a gear 51 rotatable around a center axis J, and the teeth 52 of a gear 51 are rotated by one tooth in the direction J1 by the tooth portion 46 when they are engaged with the month finger portion or month feeding tooth portion 46 of the date indicator 40. In this example, the month feeding tooth portion 46 is formed by only one tooth portion 46, so that the month feeding intermediate wheel 50 is rotated one tooth a month in the direction J1.

As can be seen from the explanatory sectional views such as FIGS. 3 and 4 and the explanatory plan view such as FIG. 2, a month indicator or month display wheel 60 has a month display wheel guide pipe 61 to which a cylindrical portion 16*a*1 of an hour wheel 16*a* is loosely fitted and which is fixed to the date indicator maintaining plate 21, a month star or month gear 64 whose hub portion 62 is rotatably fit-engaged with the guide pipe 61 and whose cuter periphery is equipped with 12 tooth portions 63, a month cam 66 in the form of a flat plate fitted to the month star 64 and having a cam surface 65 in the outer periphery thereof, and a month plate or month display plate portion 67 in the form of a thin flat plate fixed to the month gear 64.

The cam surface 65 of the month cam 66 has, in a smoothly continuous state, a long month cam surface portion 65*a* in the form of a small diameter arcuate cam surface portion of a more or less small diameter as a whole and smoothly curved in correspondence with a longer month having 31 days (which is also referred to as a "long month" in this specification), and a short month cam surface portion. 65*b* including a protrusion more or less protruding and smoothly curved in correspondence with a shorter month having 30 days or less (which is also referred to as a "short month" in this specification). Thus, it is possible for the cam follower portion to be displaced clockwise C1 with respect to the cam surface 65, to be displaced counterclockwise C2, and to reciprocate in the directions C1 and C2 within a desired range.

The month gear 64 is in mesh with a month feeding intermediate wheel 50, and is rotated by one tooth each time the month feeding intermediate wheel 50 is rotated by one tooth per month, thus making one rotation a year in the direction C1 around the center axis C.

Characters LM indicating the months of January to December (twelve in total) are displayed at equal intervals on a dial side surface 67*a* of a month display plate portion 67. As can be seen from FIGS. 3 and 4, the month display plate portion 67 is equipped with an outer peripheral edge of a slightly smaller diameter than the inner peripheral edge of the date display wheel portion 41 of the date indicator 40. Thus, the characters LM indicating the months on the dial side surface 67*a* of the month display plate portion 67 are on a side slightly nearer to the center axis C than the characters LD indicating days on the dial side surface 41*a* of the date display wheel portion 41, indicating date in the predetermined areas 13*a* and 13*b* in the date display window 13 (FIG. 1).

The rotation of the month indicator 60 in the direction. C1 is set by a month jumper 24 equipped with a month jump control finger portion 24*a* and a month jump control spring portion 24*b*. As can be seen from FIGS. 3 and 4, positional deviation in the thickness direction of the month indicator 60 is regulated by a month indicator maintaining plate 23 mounted to the month display wheel guide pipe 61 so as to regulate displacement toward the dial side of the month star 64.

The timepiece 2 has, as a manual calendar correction mechanism 5, a swaying wheel 25 that can sway in directions V1 and V2, a month corrector setting wheel 26, and a correction transmission wheel 27. When a winding stem 15*a* is rotated in one direction at a winding stein first step at which the winding stem 15*a* has been pulled out one step by pulling the crown 15, the swaying wheel 25 is moved in the direction V1 via the correction transmission wheel 27 to assume a date correction position U1 where it is brought into mesh with a date gear 45, and the date indicator 40 is rotated in the direction C2 according to the above-mentioned rotation in one direction of the winding stem 15*a* to effect date correction. On the other hand, when, at the first step of the winding stem, the winding stem 15*a* is rotated in the reverse direction, the swaying wheel 25 is moved in the direction V2 to assume a month correction position U2, where it is brought into mesh with a month gear 66, and the month indicator 60 is rotated in the direction C1 according to the reverse rotation of the winding stem 15*a* to effect month correction.

In addition to the month cam 66, the auto calendar mechanism 1 has an operating lever 70 controlling the month end feeding for a short month. The operating lever 70 as the operating lever structure is equipped with a proximal portion 71, and a first and second lever portions 74 and 77 extending integrally from the proximal portion 71.

More specifically, the substantially flat-plate-like proximal portion 71 of the operating lever 70 is equipped with a fit-engagement portion 72 consisting of a round hole 72*a* and a slit-like opening 72*b* continuous with the round hole 72*a*, and the operating lever is fit-engaged such that the peripheral surface 72*c* of the round hole 72*a* is friction-engaged with the outer peripheral surface 36*a* of the columnar offset pin 36 of the date finger 33. In this fit-engagement state, the slit-like opening 72*b* is slightly elastically opened to provide a frictional engagement force, and in the state in which it receives no external force, the proximal portion 71 of the operating lever 70 is rotated together with the offset pin 36 (i.e., integrally rotated) around the rotation center axis H in response to the rotation of the date finger 33 caused by the rotation, of the date indicator driving wheel 30. On the other hand, when, in the case where the proximal portion 71 is regulated, the compulsory force due to the regulation attains a level in excess of the frictional engagement force, slippage is generated between the peripheral surface 72*c* of the round, hole 72*a* of the proximal portion 71 of the operating lever 70 and the outer peripheral surface 36*a* of the offset pin 36, and the proximal portion 71 of the operating lever 70 rotates with respect to the offset pin 36 of the date finger 33. Typically, the offset pin 36 and the hole 72*a* are both circular. In some cases, however, one of them may be of a non-circular configuration such as a polygonal configuration with rounded corners (generally a regular polygon).

The first lever portion of the operating lever 70, or the first, lever portion 74, is in the form of a first elastic arm portion 75 generally arcuately curved along a plane parallel to the extension plane of the timepiece 2, and is equipped with a proximal end portion 75*a* integrally connected to the proximal portion 71, a distal end portion 75*b*, an a first distal end portion raised perpendicularly at the distal end portion 75*b* with respect to the extension plane, with the first distal end portion consisting of a small columnar portion 75*d* acting as a cam follower or engagement portion 75*c*.

Figure 23:
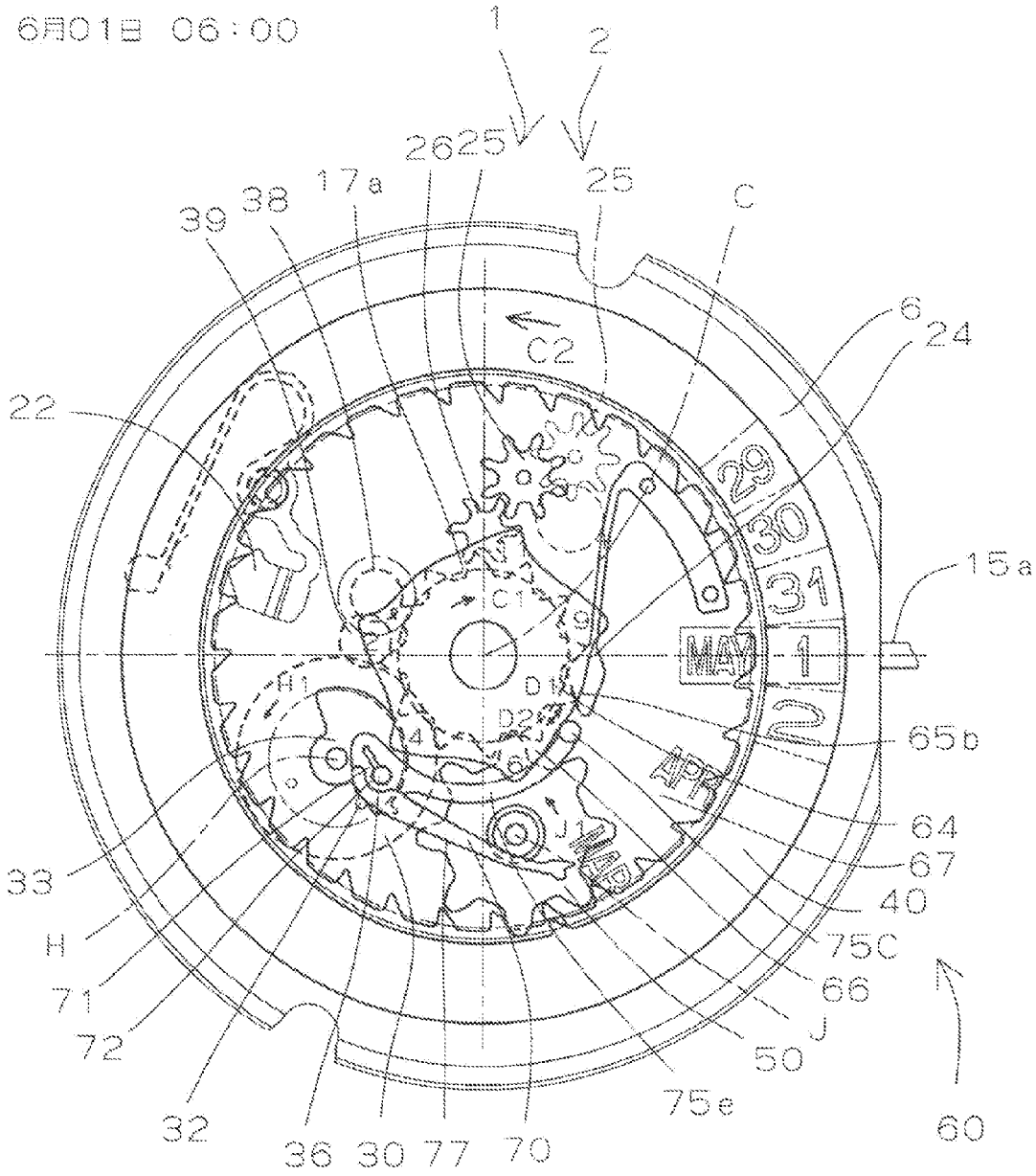
FIG. 23 is an explanatory plan view of the calendar mechanism of FIG. 1 showing it as indicating around 6 o'clock a.m. on June 1.
Figure 24:
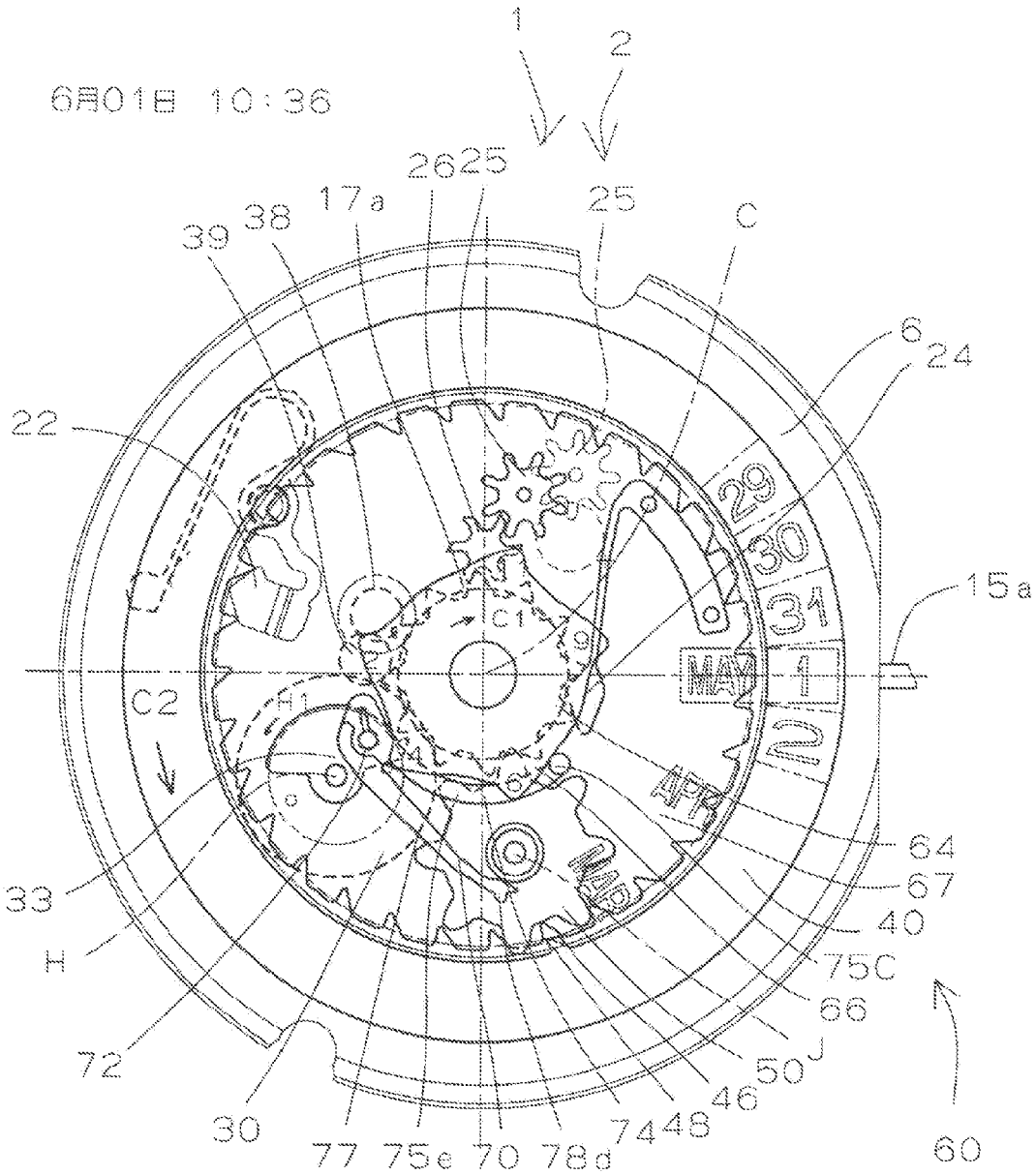
FIG. 24 is an explanatory plan view of the calendar mechanism of FIG. 1 showing it as indicating around 36 minutes past 10 o'clock a.m. on May 30.

Thus, as can be seen, for example, from FIG. 3, the portion of the first elastic arm portion 75 other than the pin-like cam follower portion, that is, the curved, arm main body portion 75*e* between the proximal portion 75*a* and the distal end portion 75*b*, is situated so as to be deviated downwards (toward the case back side) as compared with the month cam 66 in the form of a flat-plate-like member as seen in the thickness direction of the timepiece 2, and can enter the back of the month cam 66 (the overlapping position as seen from the dial side) in a non-interfered state (for more details, see FIGS. 23 and 24 mentioned below). On the other hand, as can be seen from FIG. 3, the engagement portion 75*c* constituting the distal end portion of the small columnar portion 75*d* of the first lever portion 74 of the operating lever 70 is at the same level as the month cam 66 as seen in the thickness direction of the timepiece 2, and can abut the outer peripheral surface of the month cam 66, i.e., the cam surface 65. As stated above, and, as can be seen, for example, from FIG. 2, one cam surface 65 of the month cam 66 is actually a surface smoothly continuous, so that the cam follower or engagement portion 75*c* can be displaced both clockwise and counterclockwise with respect to the cam 65 while being in contact with the cam 65.

At the relative position, as shown in FIG. 2 (the relative position at which the rotational direction H1 of the date indicator driving wheel 30 is such that the cam follower portion 75*c* at the distal, end of the first lever portion 74 is pressed against the cam surface 65 of the month cam 66), the proximal portion 71 of the operating lever 70 is fit-engaged so as to be friction-engaged with the offset pin 36 of the date finger 33 of the dace indicator driving wheel 30, so that, as the date indicator driving wheel 30 is rotated in the direction H1, the cam follower or engagement portion 75*c* at the distal end of the first lever portion 74 of the operating lever 70 is actually constantly pressed against the cam surface 65 of the month cam 66.

The second lever portion of the operating lever 70 or the second, lever portion 77 is formed as a second elastic arm portion 78 extending generally linearly along a plane parallel to the extension plane of the timepiece 2 from the proximal portion 71 so as to be forked in cooperation with the first lever portion 74. Here specifically, the second elastic arm portion 78 of the second lever portion 77 has a proximal portion 78*a* integrally connected to the proximal portion 71, an arm main body portion 7 to extending generally linearly from the proximal portion 78*a* and slightly curved at the curved portion 78*b* at the distal end side, and a short month end feeding finger portion 78*d* formed at the second distal end portion, which is the distal end of the arm main body portion 78*c*. The feeding finger portion 78*d* is formed as a forked portion 78*f* having at the distal end thereof an engagement recess 78*e* so that it can be reliably engaged with the month end feeding tooth 48 and press the month end tooth 48 in the direction C2.

As can be seen from FIGS. 4 and 2, the second elastic arm portion 78 of the operating lever 70 is situated nearer to the dial 12 than the first elastic arm portion 75 and can be engaged with the month end tooth 48 of the date indicator 40. Further, the second elastic arm portion 78 is equipped with a curved portion 78*b* in the vicinity of the distal end and can be curved, so that, as described in detail with reference to FIGS. 7 and 8 below, it is curved by the month end tooth 48 when the month end tooth 48 is pressed against an outer side edge 78*g* at the distal end portion from behind in the direction C2, and allows itself to be left behind by the month end tooth 48 in the direction C2.

The angle made by the first and second lever portions 74 and 77 is formed as follows: when, in a long month, the cam follower portion 75*c* at the distal end of the first lever portion 74 is in contact with the month cam 66, the feeding finger portion 78*d* of the second lever portion 77 is situated on the radially inner side of the distal end of the month end tooth 48 so that it may not interfere with the month end tooth 48; when, in a short month, the cam follower portion 75*c* at the distal end of the first lever portion 74 is in contact with the month cam 66, the feeding finger portion 78*d* of the second lever portion 77 comes into contact with the month end tooth 48 so that additional date feeding can be effected at the month end.

Next, the operation of the auto calendar mechanism 1 of the timepiece 2 according to an embodiment of the present invention, constructed as described above, will be successively described with reference to FIGS. 2 and 5 through 24 in addition to FIGS. 1, 3, and 4.

FIG. 2 shows the timepiece as indicating around 30 minutes past 3 o'clock p.m., on April 29, that is, in the state during the daytime of a day other than the month end of a short month (that is, before date changing operation is started). In this state, the cam follower portion or engagement portion 75*c* of the first lever portion 74 of the operating lever 70 faces a region 65*b*2 which is in the vicinity of the apex 65*b*1 of the short month cam surface portion 65*b* of the month cam 66 but spaced away from the apex 65*b*1, and is pressed against the region 60*b*2 under the action of the pressing force of the date pin 32 due to the rotation in the direction H1 of the date indicator driving wheel 30. The cam follower portion or engagement portion 75*c* is in contact with the region 65*b*2 spaced away from the apex 65*b*1, so that the feeding finger portion 78*d* of the distal end of the second lever portion 77 of the operating lever 70 is situated at a position spaced away from the month end tooth or month feeding tooth 48 of the date indicator 40, that is, on the radially inner side of the distal end of the month end feeding tooth 48. The time of around 30 minutes past 3 o'clock is during the daytime, so that the jump control finger portion 22*a* of the date jumper 22 sets the date gear portion 45 between adjacent tooth portions 47 of the date gear portion 45. Further, although the date of April 23 is close to the month end, the timepiece is in the state before the last day of the month is reached, so that the month feeding tooth 46 of the date indicator 40 is situated at a position spaced away from the tooth 52 of the month feeding intermediate wheel 50, and the jump control finger portion 24*a* of the date jumper 24 sets the month, gear 64 between adjacent tooth portions 63 of the month gear 64. Accordingly, "APR" indicating April is displayed in the month display area 13*a* of the date display window 13 as the month display characters LM, and the number "29" is displayed in the date display area 13*b* as the date display characters LD indicating the $29^{th}$ day.

After this state, in response to the rotation of the date indicator driving wheel 30 with the passage of time, the date finger main body portion 35 is engaged with the tooth portion 47*a* situated closest to the date indicator driving wheel 30 to rotate the date indicator 40 in the direction C2, thereby effecting date feeding. As a result, the date display characters LD in the date indicating area 13*b* of the date display window 13 is changed from "29" to "30." FIG. 5 shows the timepiece as indicating around 9 o'clock p.m. on April 30 after the date change.

Figure 5:
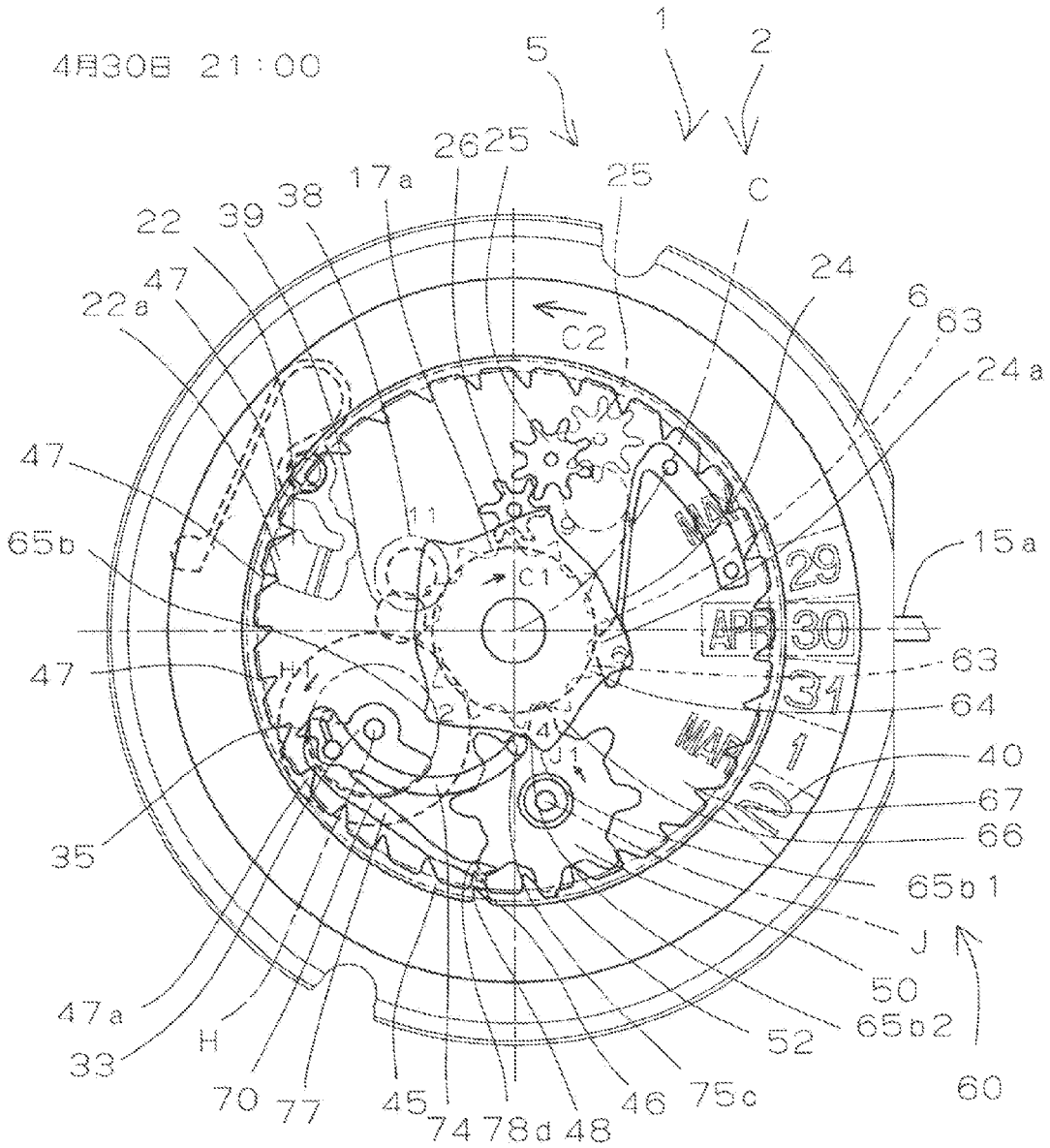
FIG. 5 is an explanatory plan view of the calendar mechanism of FIG. 1 showing it as indicating around nine o'clock p.m. on April 30.

As in the case of FIG. 2, which shows the state around 30 minutes past 3 o'clock p.m. on April 29, in the state of FIG. 5, which shows the state around 9 o'clock p.m. on April 30, the cam follower portion 75*c* of the first lever portion 74 of the operating lever 70 abuts the region 65*b*2 in the vicinity of the apex 55*b*1 of the short, month cam surface portion 65*b* of the month cam 66; the feeding finger portion 78*d* at the distal end of the second lever portion 77 is situated away from the distal end of the month feeding tooth 48 of the date indicator 40; the main body portion 35 of the date finger 33 is spaced away from the closest tooth 47*a* of the date gear portion 45; the month feeding tooth 46 of the date indicator 40 is situated away from the tooth 52 of the month feeding intermediate wheel 50; and the lump control finger portion 22*a* of the date jumper 22 sets the date gear portion 45 between the adjacent tooth portions 47 of the date gear portion 45, with the jump control finger portion 24*a* of the month jumper 24 setting the month gear 64 between the adjacent tooth portions 63 of the month gear 64.

Figure 6:
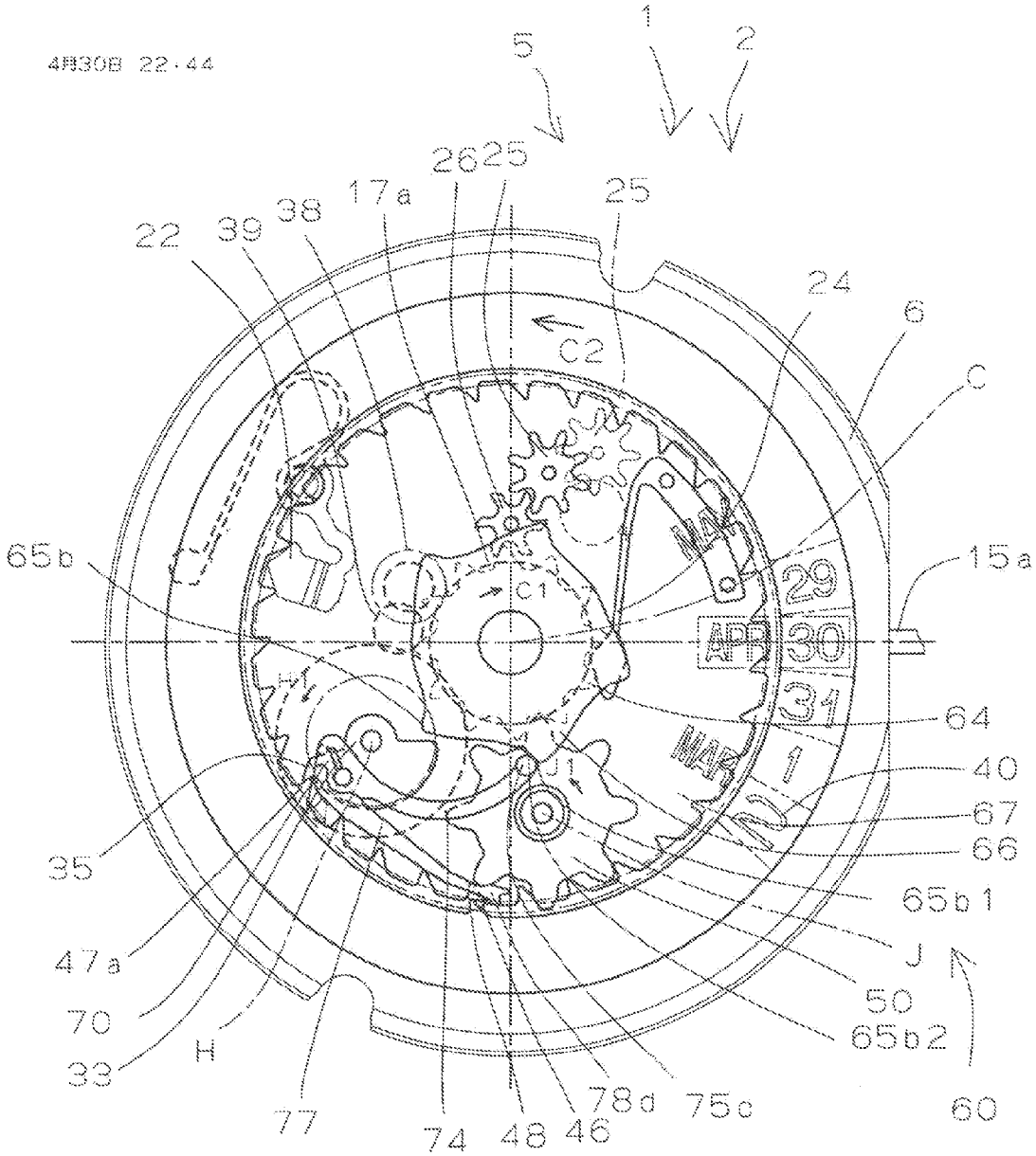
FIG. 6 is an explanatory plan view of the calendar mechanism, of FIG. 1 showing it as indicating around 44 minutes past ten o'clock p.m. on April 30.

As shown in FIG. 6, around 44 minutes past 10 o'clock p.m. on April 30, which is a time near the end or a short month, the main body portion 35 of the date finger 33 abuts the closest tooth 47*a* of the date gear portion 45 to start date feeding. In this state, the cam follower portion 75*c* of the first lever portion 74 of the operating lever 70 approaches the apex 65*b*1 of the short month cam surface portion 65*b* of the month cam 66, but is still in the region 65*b*2 spaced away from it, with the feeding finger portion 78*d* at the distal end of the second lever portion 77 being situated away from the distal end of the month feeding tooth 48 of the date indicator 40.

Figure 7:
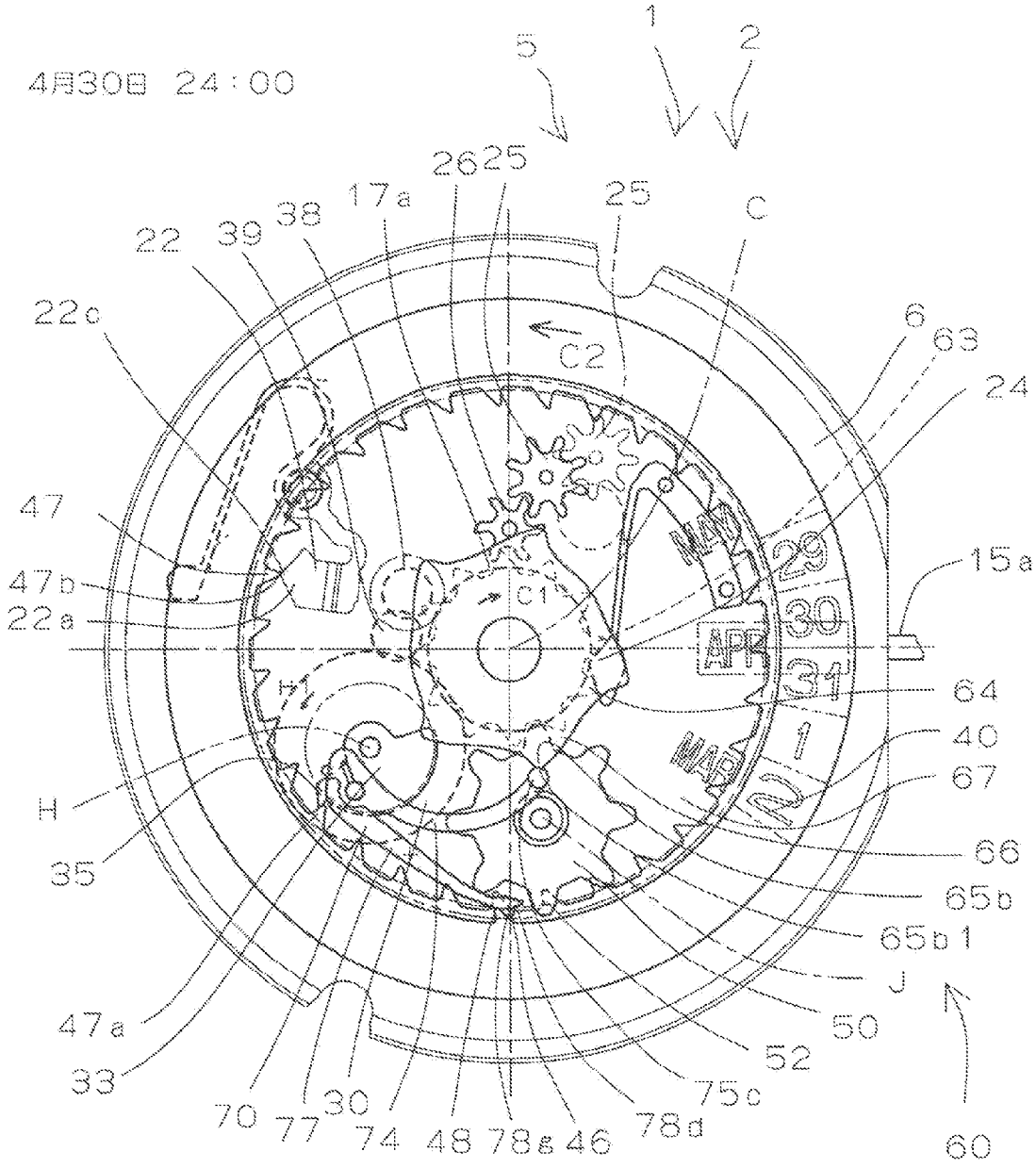
FIG. 7 is an explanatory plan view of the calendar mechanism, of FIG. 1 showing it as indicating around twelve o'clock p.m. on April 30 (in the state in which the apex of a jump control finger portion of a date jumper is engaged with the apex of a tooth).

As shown in FIG. 7, after further passage of time, the time around 12 o'clock p.m. on April 30, which is the end of the month end day of a short month, is attained, the main body portion 35 of the date finger 33 abuts the closest tooth 47*a* of the date gear portion 43 to perform date feeding, and the state is attained in which the apex 22*c* of the jump control finger portion 22*a* of the date jumper 22 is engaged with the apex 47*b* of the tooth 47 of the date gear 45. In this state, there are displaced, as the date display characters LD, intermediate portions between "30" indicating $30^{th}$ day and "31" indicating $31^{st}$ day. Further, the cam follower portion 75*c* of the first lever portion 74 of the operating lever 7Q is actually engaged with the apex 65*b*1 of the short month cam surface portion 65*b* of the month cam 66, and the month end feeding finger portion 48 of the date indicator 40 approaches or abuts the outer side edge 78*g* of the feeding finger portion 78*d* at the distal end of the second lever portion 77 of the operating lever 70 to start to push away the feeding finger portion 78*d* of the second lever portion 77.

Figure 8:
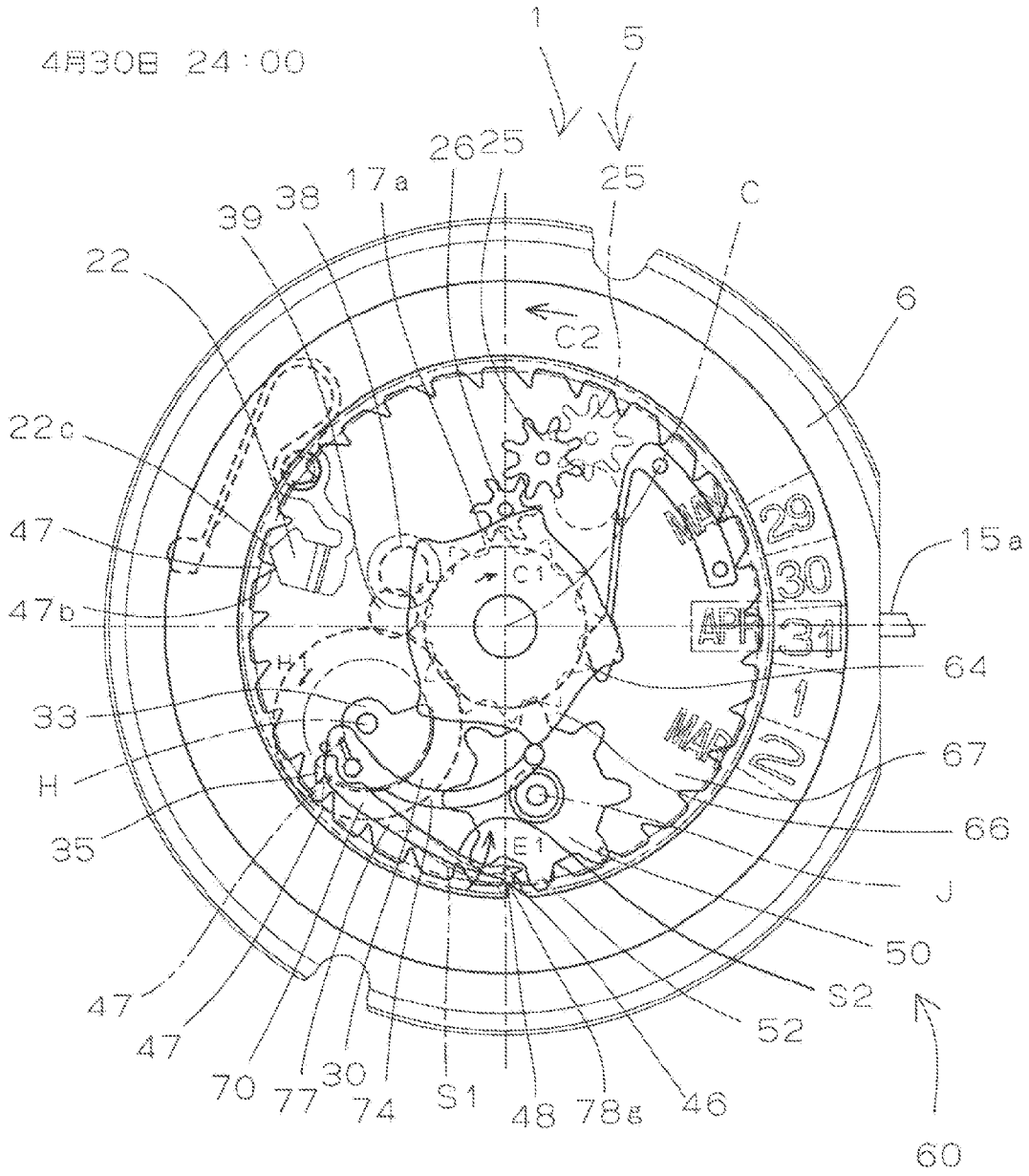
FIG. 8 is an explanatory plan view of the calendar mechanism of FIG. 1 showing it as indicating around twelve o'clock p.m. on April 30 (in the state in which the apex of the jump control finger portion has got over the apex of the tooth).

As shown in FIG. 8, when, immediately after the state of FIG. 7, at substantially the same time, i.e., around 12 o'clock p.m. on April 30, the apex 22*c* of the jump control finger portion 22*a* of the date jumper 22 gets over the apex 47*b* of the tooth portion 47, the jump control finger portion. 22*a* abruptly drops from the tooth portion 47 under the action of the spring force of the spring portion 22*b* of the date jumper 22, and, at the same time, pushes the tooth portion 47 in the direction C2. At the same time, the date indicator 40 is abruptly fed in the direction C2 to proceed date feeding, and the month end feeding tooth 48 pushes the outer side edge 78*g* of the feeding finger portion 78*d* at the distal end of the second lever portion 77 to elastically deflect the main body portion 78*c* of the second elastic arm portion 78 of the second lever portion 77 in the direction E1 from the non-deflected state S1 indicated by the phantom line to the deflected state S2 indicated by the solid line, pushing away the feeding finger portion 78*d* and leaving the feeding finger portion 78*d* behind to move forward in the direction C2 beyond the feeding finger portion 78*d*.

Figure 9:
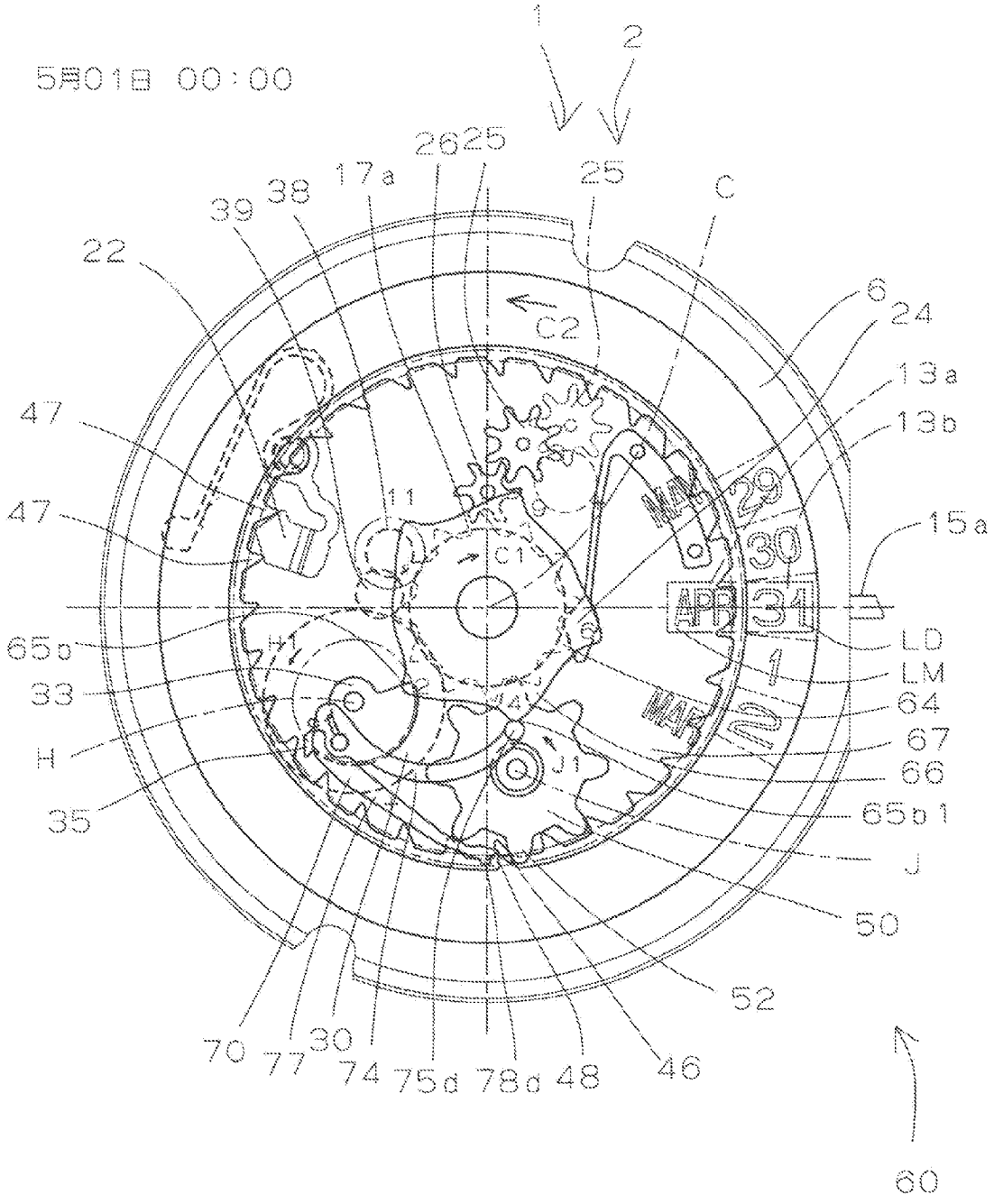
FIG. 9 is an explanatory plan view of the calendar mechanism of FIG. 1 showing it as indicating around twelve o'clock a.m. on May 1 (in the state in which the jump control finger portion of the jumper has been completely dropped between adjacent teeth).

Further, as shown in FIG. 9, immediately after the state of FIG. 8, at substantially the same time, i.e., around 12 o'clock p.m. on April 30, in other words, around 12 o'clock a.m. on May 1, the jump control finger portion 22*a* of the date jumper 22 completely drops between the next adjacent tooth portions 47 to set the date indicator again. At the same time, the final date feeding from "30" to "31" is effected, and the display characters LD in the date display area 13*b* are changed to "31". This date feeding is effected, by the date feeding finger 33 under the action of the date jumper 22 with the same timing as the normal date feeding. Further, the month end feeding tooth 48 is completely separated from the feeding finger portion 78*d* of the second lever portion 77 of the operating lever 70, and the month feeding tooth 46 approaches the tooth 52 of the month feeding intermediate wheel 50.

Figure 10:
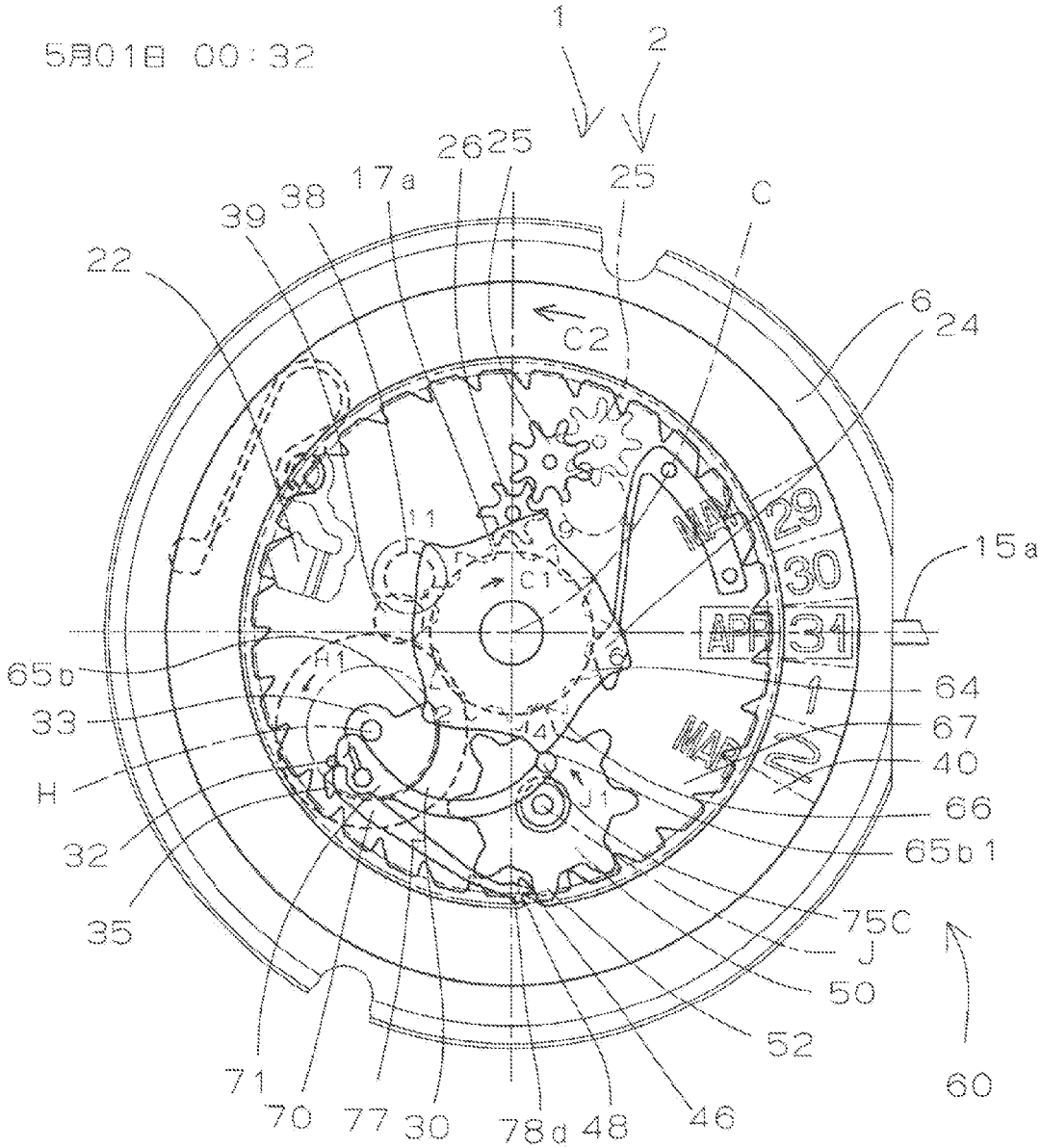
FIG. 10 is an explanatory plan view of the calendar mechanism of FIG. 1 showing it as indicating around 32 minutes past twelve o'clock a.m. on May 1 (in the state in which additional date feeding is started at the end of a short month).
Figure 1:
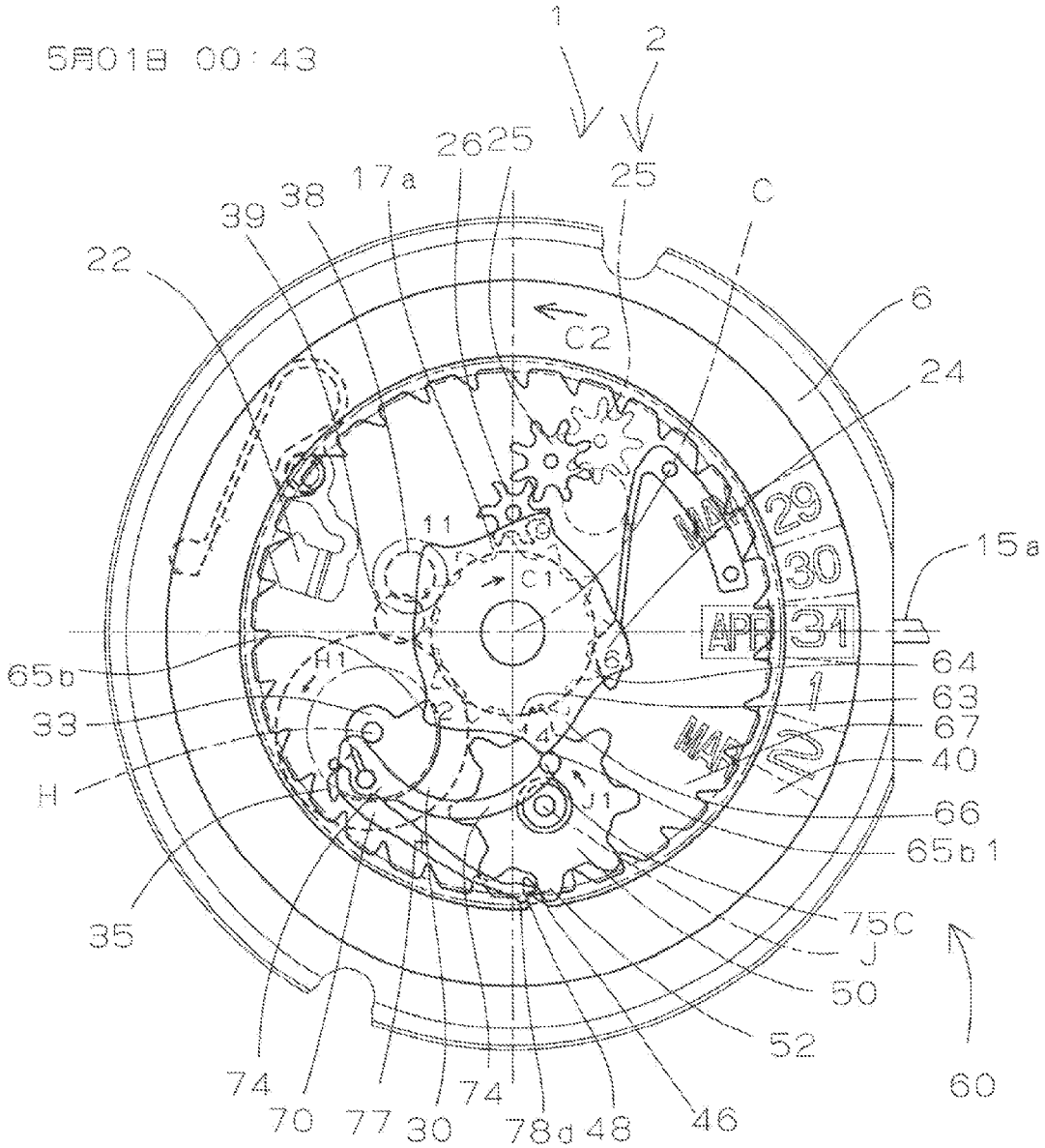

As shown in FIG. 10 and the enlarged view and the explanatory sectional view of FIGS. 11(*a*) and 11(*b*), when, after this, some time has elapsed to attain around 32 minutes past 12 o'clock a.m. on May 1, the feeding finger portion 78*d* of the second lever portion 77 abuts the month end tooth 48 due to the rotation of the offset pin 36 caused by the rotation of the date feeding finger 33 in response to the rotation of the date indicator driving wheel 30, and to the rocking of the cam follower portion operating lever 70 in the state in which the cam follower portion 75*c* of the first lever portion 74 is held in contact with the apex 65*b*1 of the short month cam surface portion 65*b* of the month cam 65. As a result, after this, additional date feeding at the end of the short month is started. At this time, the month feeding tooth portion 46 of the date indicator 40 is also at a position in close proximity to the tooth portion 52 of the month feeding intermediate wheel 50.

Further, as shown in FIG. 12, when some time has elapsed to attain around 43 minutes past 12 o'clock a.m. on May 1, the feeding finger portion 78*d* of the second operating lever portion 77 of the operating lever 70 whose cam follower portion 75*c* is in contact with the apex 65*b*1 of the snort month cam surface portion 65*b* starts to feed the month end tooth. 48 in response to the rotation of the offset pin 36 due to the rotation of the date feeding finger 33 caused by the rotation of the date indicator driving wheel 30, and the month feeding tooth 46 abuts the tooth 52 of the month feeding intermediate wheel 50 due to the resultant rotation in the direction C2 of the date indicator 40*p* and, after this, the rotation of the month gear 64 of the month fencing intermediate wheel 50 by the month feeding tooth 46, that is, month feeding, is started. The point in time when the feeding finger portion 78*d* of the operating lever portion 77 starts to feed the month end tooth 48 and the point in time when the feeding of the month feeding intermediate wheel 50 by the month feeding tooth 46 is started, are somewhat deviated from each other; the interval may be shorter or longer so long as the deviation is not excessive.

Figure 13:
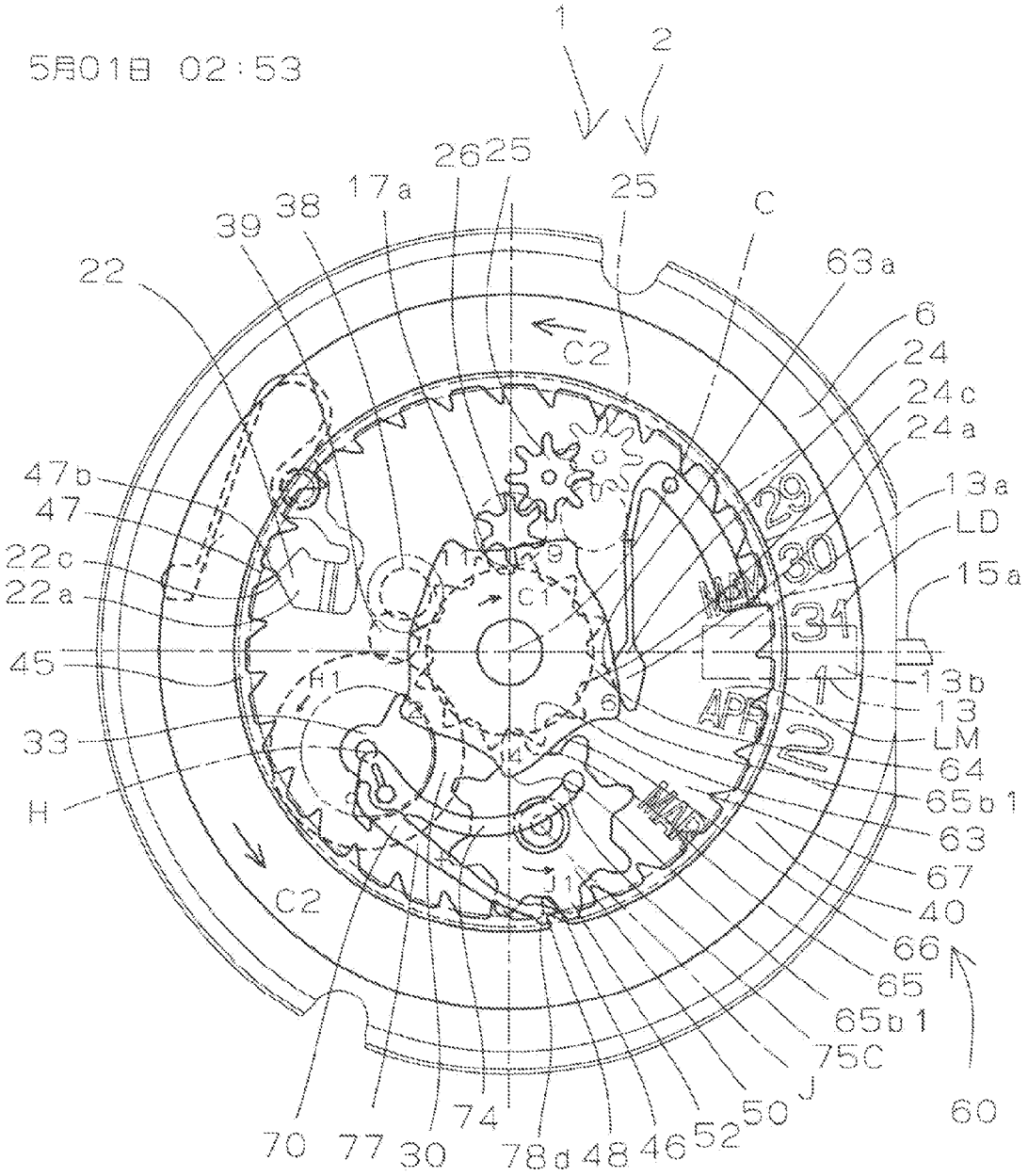
FIG. 13 is an explanatory plan view of the calendar mechanism of FIG. 1 showing it as indicating around 53 minutes past 2 o'clock a.m. on May 1 (in the state in which the apexes of the jump control finger portions of the date jumper and the month, jumper are engaged with the apex of a related tooth).

As shown in FIG. 13, when, after this, some time has elapsed to attain around 43 minutes past 2 o'clock a.m. on May 1, the feeding finger portion 78*d* of the second operating lever-portion 77 of the operating lever 70 pushes the month end tooth 48 to effect date feeding, and the state is attained in which the apex 22*c* of the jump control finger portion 22*a* of the date jumper 22 is engaged with the apex 47*b* of the tooth 47 of the date gear 45. In this state, intermediate portions between "31" indicating 31$^{st}$ day and "1" indicating the next day, i.e., 1st day, are displayed as the date display characters LD in the date display area 13*b* of the date display window 13. Further, as the date indicator 40 rotates, the month feeding tooth 46 is engaged with the tooth 52 of the month feeding intermediate wheel 50 to rotate the month gear 64 via the month feeding intermediate wheel 50, and the state is attained in which the apex 24*c* of the jump control finger portion 24*a* of the month jumper 24 is engaged with the apex 63*a* of the tooth 63 of the month gear 64. Accordingly, in the month display area 13*a* of the date display window 13, there are displayed, as the month display characters LP, intermediate portions between "APR" indicating April and "MAY" indicating the next month, i.e., May. When the feeding finger portion 78*d* of the second lever portion 77 of the operating lever 70 is engaged with the month end tooth 48, the feeding finger portion 78*d* of the second lever portion 77 is kept engaged with the month end tooth 48 so long as the date indicator driving wheel 30 and the date indicator 40 are in the rotation regions in the direction H1 and the direction C2 permitting the engagement state, so that, as shown in FIG. 13, the can follower portion 74*c* of the first lever portion 74 of the operating lever 70 is placed in the state in which it is spaced away from the cam surface 65 of the month cam 66.

Figure 14:
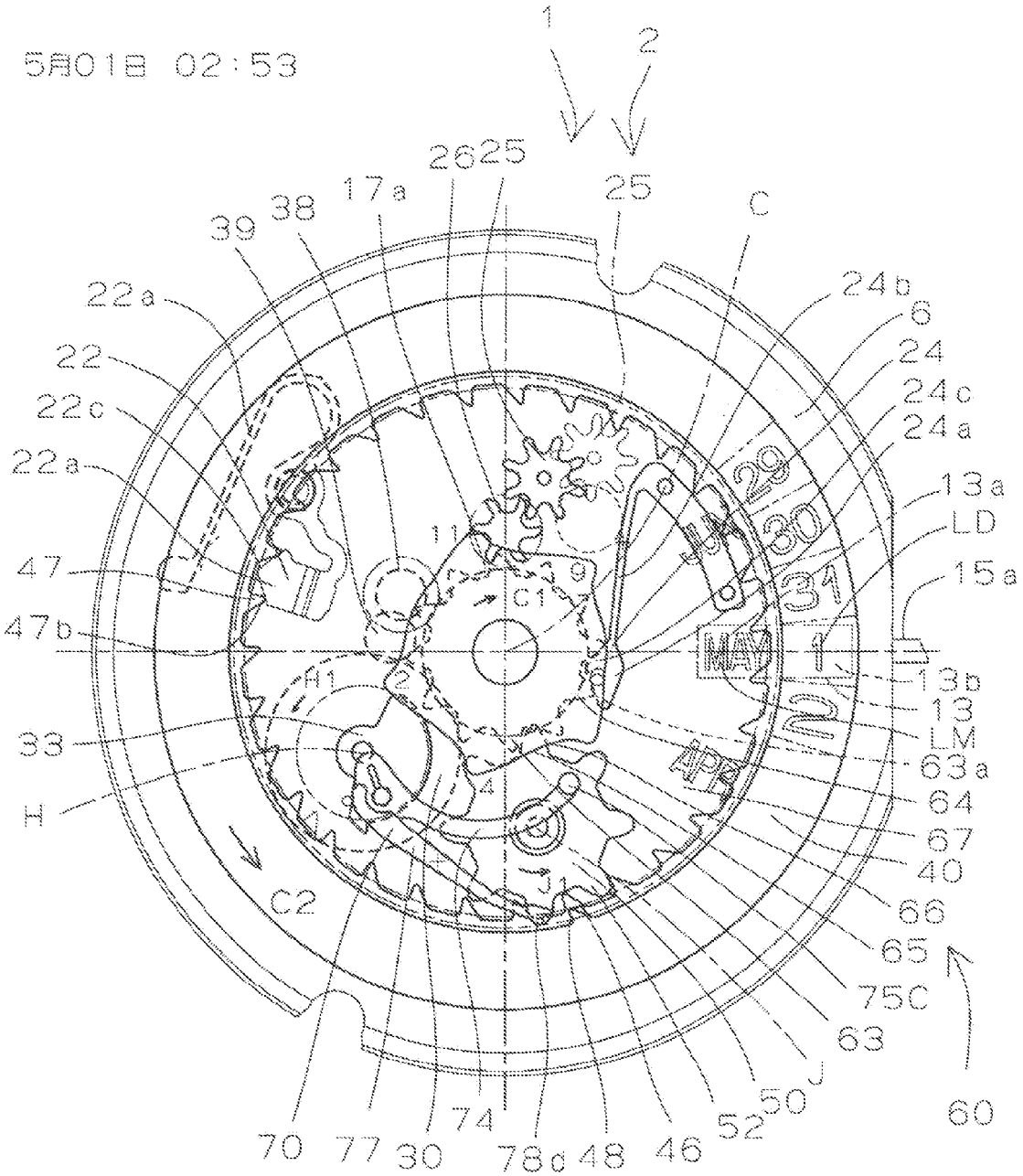
FIG. 14 is an explanatory plan view of the calendar mechanism of FIG. 1 showing it as indicating around 53 minutes past 2 o'clock a.m. on May 1 (in the state in which the jump control finger portion of the jumper has been completely dropped between adjacent teeth).

As shown in FIG. 14, when, immediately after the state of FIG. 13, at substantially the same time, i.e., around past 53 minutes 2 o'clock a.m. on May 1, the apex 22*c* of the jump control finger portion 22*a* of the date jumper 22 gets over the apex 47*b* of the tooth portion 47, the jump control finger portion 22*a* abruptly drops from the tooth portion 47 under the action of the spring force of the spring portion 22*b* of the date jumper 22, and, at the same time, pushes the tooth portion 47 in the direction C2. At the same time, the date indicator 40 is abruptly fed in the direction C2 to proceed date feeding, and the jump control finger portion 22*a* of the date jumper 22 completely drops between the next adjacent tooth portions 47, whereby the date gear 45 is set again. Similarly, when the apex 24*c* of the lump control finger portion 24*a* of the month jumper 24 gets over the apex 63*a* of the tooth portion 63, the jump control finger portion 24*a* drops abruptly from the tooth portion 63 under the action of the spring force of the spring portion 24*b* of the month jumper 24, and pushes the tooth portion 63 in the direction C1 to abruptly feed the month indicator 60 in the direction C1 to proceed month feeding; and the jump control tooth portion 24*a* of the month jumper 24 drops completely between the next adjacent tooth portions 63, whereby the month gear 64 is set again. As a result, the date feeding from "31" to "1" is completed, and the display character LD in the date display area 13*b* is changed to "1," and, at the same time, the month feeding from "APR" to "MAY" is completed, with the display characters LM in the month display area 13*a* being changed to "MAY." At this time, the month end tooth 48 of the date indicator 40 is separated from the feeding finger portion 78*d* of the second operating lever portion 77, and the tooth 52 of the month feeding intermediate wheel 50 is separated from the month feeding finger 46 of the date indicator 40. The cam follower portion 75*c* of the first lever portion 74 of the operating lever 70 remains spaced away from the cam surface 65 of the month cam 66.

Figure 15:
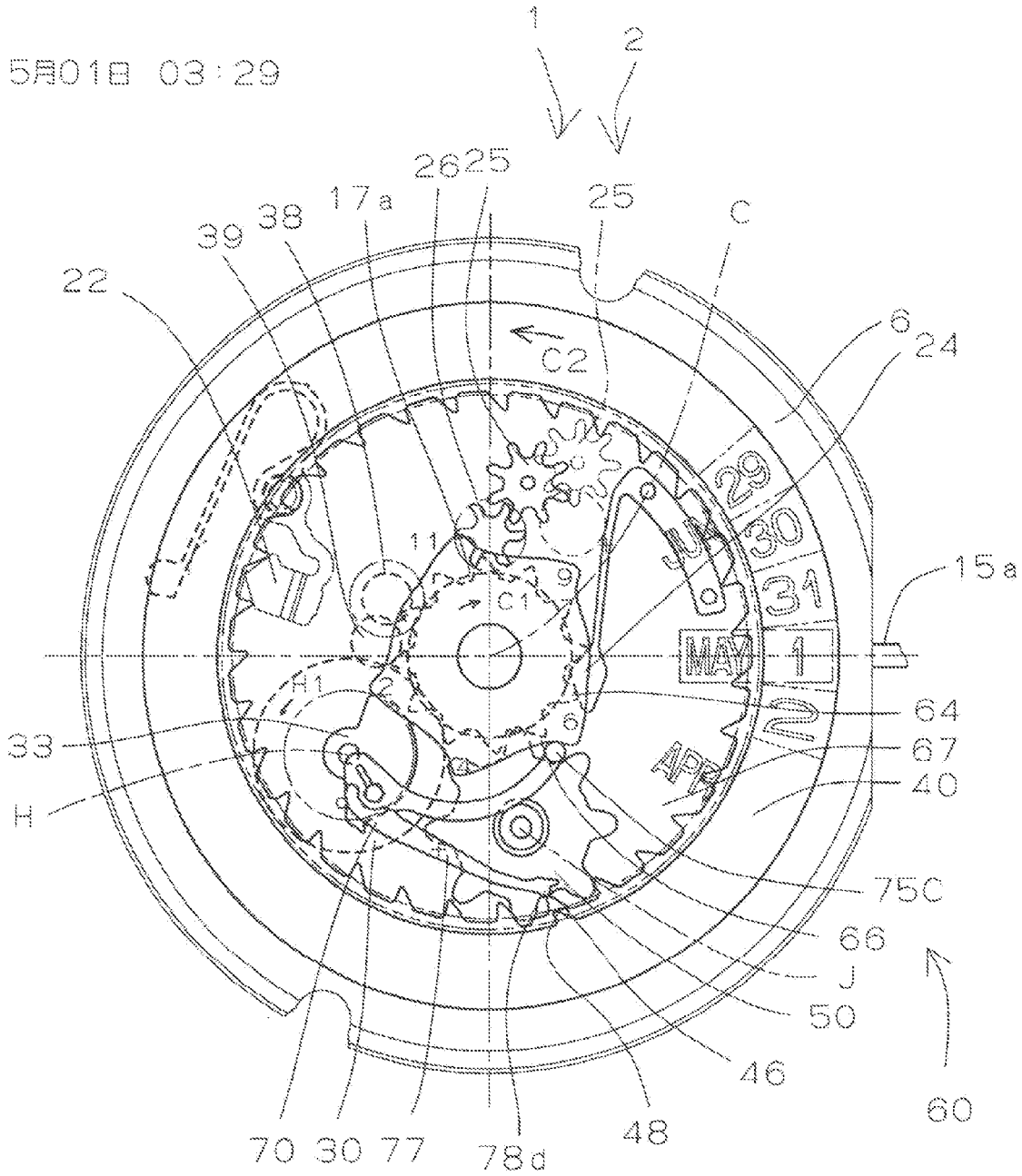
FIG. 15 is an explanatory plan view of the calendar mechanism of FIG. 1 showing it as indicating around 29 minutes past 3 o'clock a.m. on May 1.

As shown in FIG. 15, when further time has elapsed to attain around 29 minutes past 3 o'clock a.m. on May 1, the state is attained in which the cam follower portion 75*c* of the first lever portion 74 of the operating lever 70 again abuts the cam surface 65 of the month cam 66 due to the rotation of the date feeding finger 33 as a result of the rotation in the direction H1 of the date indicator driving wheel 30, and the feeding finger portion 78*d* of the second operating lever 77 moves radially inwards to radially move away from the month end tooth 48.

Figure 16:
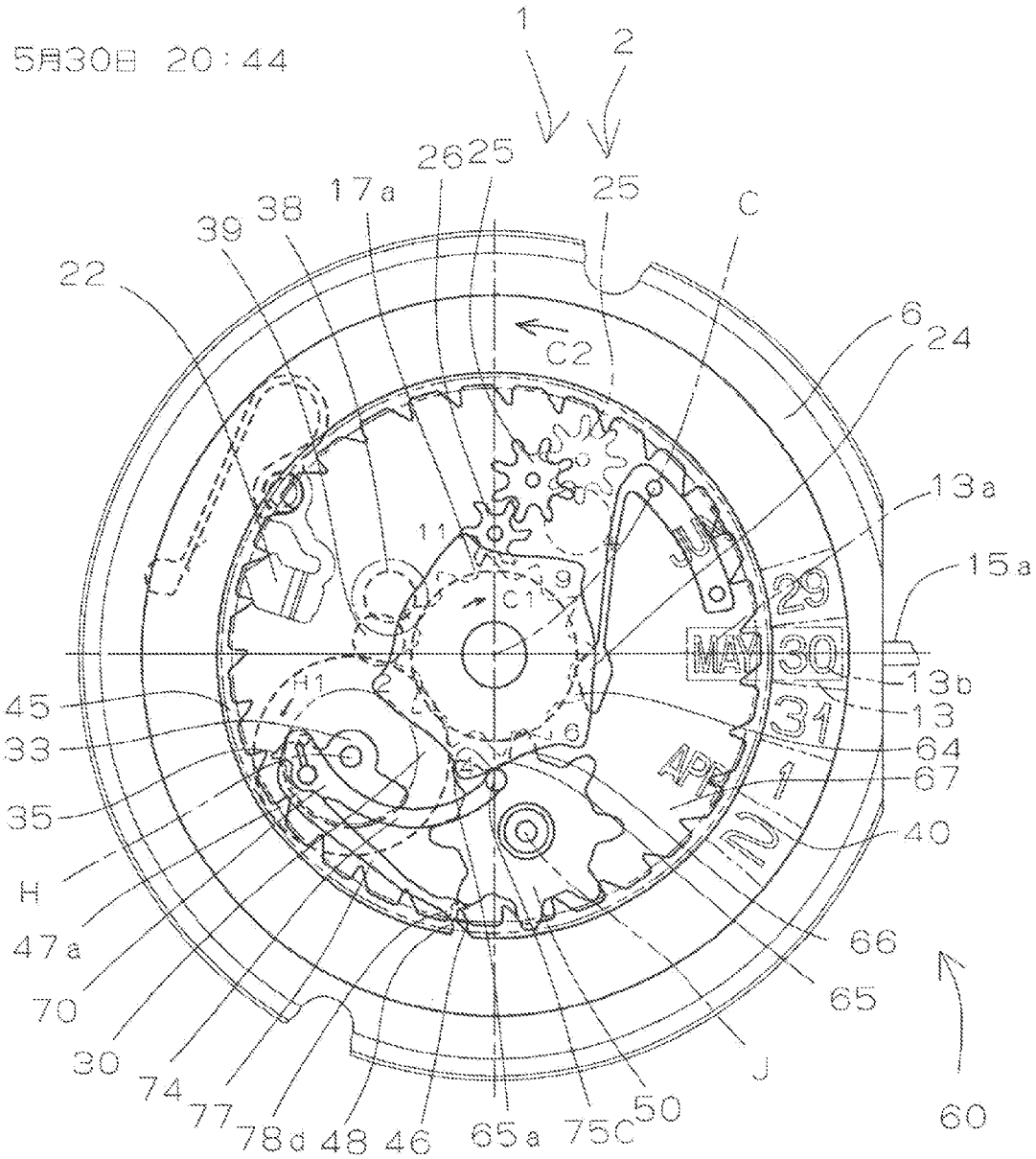
FIG. 16 is an explanatory plan view of the calendar mechanism of FIG. 1 showing it as indicating around 44 minutes past 8 o'clock p.m. on May 30.

After this, normal date feeding is repeated; for example, around 44 minutes past 8 o'clock p.m. on May 30, the state as shown in FIG. 16 is attained. In this state, the date jumper 22 and the month jumper 24 see the date gear 45 and the month gear 64, and "MAY" and "30" are displayed in the areas 13*a* and 13*b* of the date display window 13. The cam follower portion 75*c* of the first lever portion 74 of the operating lever 70 abuts the long month cam surface 65*a* region of the cam surface 65 of the month cam 66, and the feeding finger portion 78*d* of the second operating lever 77 is situated so as to be radially spaced, away from the month end tooth 48. The main body portion 35 of the date feeding finger 33 of the date indicator driving wheel 30 is situated at a position approximately two hours prior to the position where it is engaged with the closest tooth 47*a* of the date indicator 40.

Figure 17:
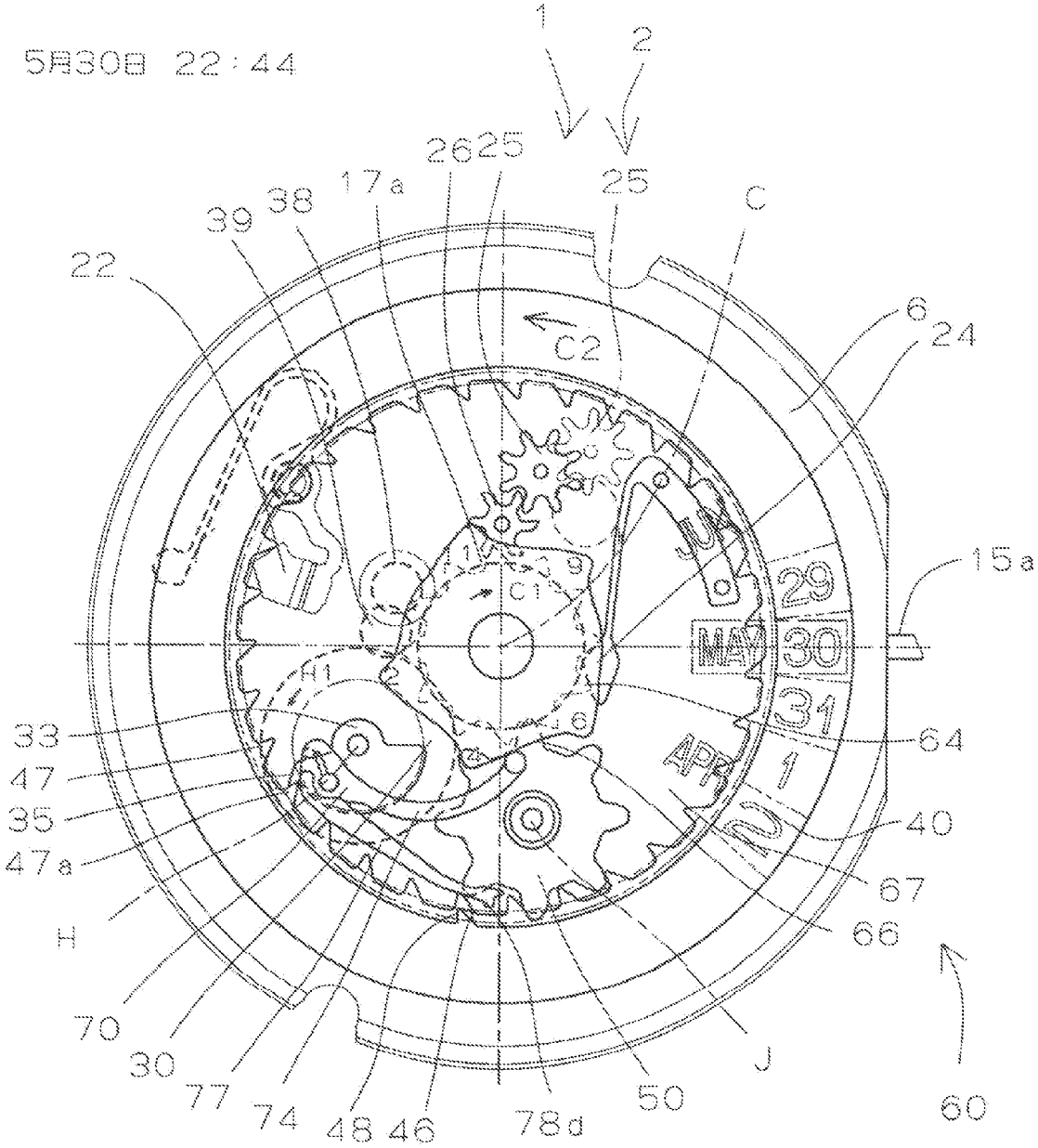
FIG. 17 is an explanatory plan view of the calendar mechanism of FIG. 1 showing it as indicating around 44 minutes past 10 o'clock p.m. on May 30.

As shown in FIG. 17, when approximately two hours have elapsed after this to attain around 44 minutes past 10 o'clock p.m. on May 30, the main body portion 35 of the date feeding finger 33 of the date indicator driving wheel 30 is engaged with the closest tooth 47*a* of the date indicator 40, and date feeding of the date indicator 40 in the direction C2 is started.

Figure 18:
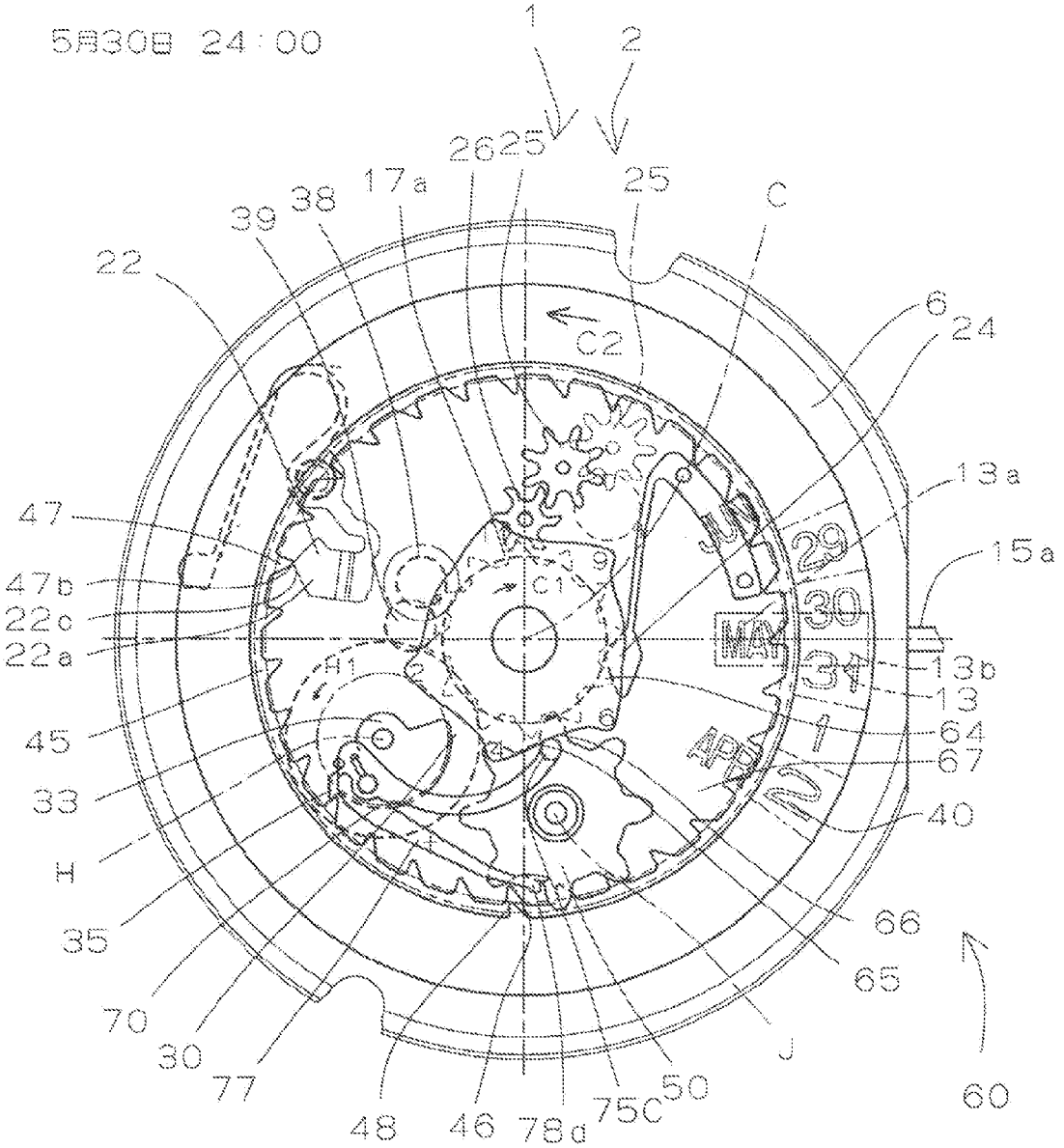
FIG. 18 is an explanatory plan, view of the calendar mechanism of FIG. 1 showing it as indicating around 12 o'clock p.m. on May 30 (in the state in which the apex of the jump control finger portion of the date jumper is engaged with the apex of a tooth).

As shown in FIG. 18, when further time has elapsed to attain around 12 o'clock p.m. on May 30, the state is attained in which the date change is being effected (the state immediately before the completion of the change), with the apex 22*c* of the jump control finger portion 22*a* of the date jumper 22 being just in contact with the apex 47*b* of the tooth 47 of the date gear 45; and intermediate portions between "30" and "31" are displayed in the area 13*b* of the date display window 13.

Figure 19:
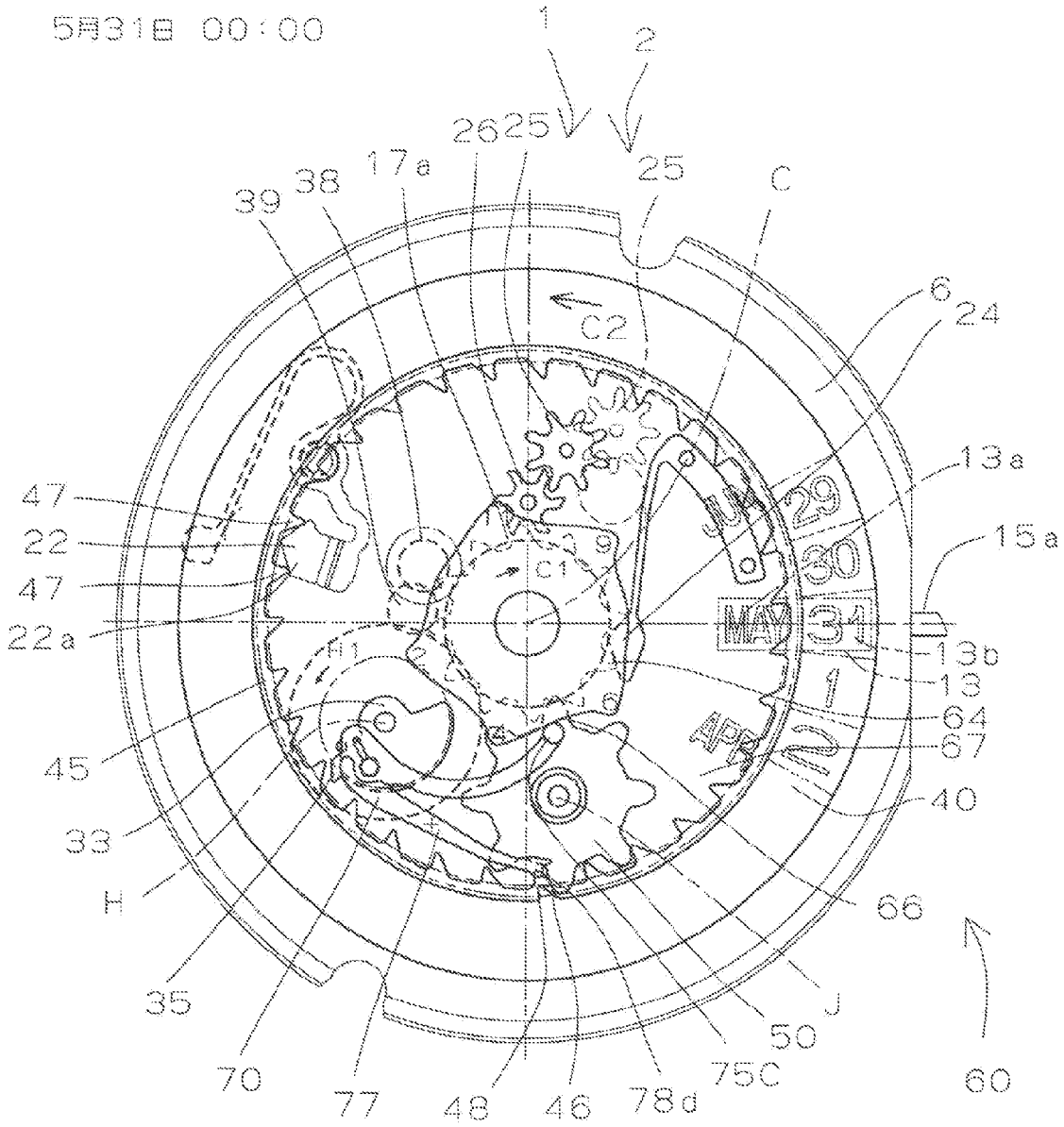
FIG. 19 is an explanatory plan view of the calendar mechanism of FIG. 1 showing it as indicating around 12 o'clock a.m. on May 31 (in the state in which the jump control, finger portion of the date jumper has been completely dropped between adjacent teeth).

As shown in FIG. 19, when, immediately after this and actually at the same time, that is, around 12 o'clock a.m. on May 31, the jump control finger portion 24*a* of the date jumper 22 drops between the adjacent teeth 47 of the date gear 45, the date feeding is completed, and the date jumper 22 sets the date gear 45 again, with "MAY" and "31" being displayed in the areas 13*a* and 13*b* of the date display window 13.

Figure 20:
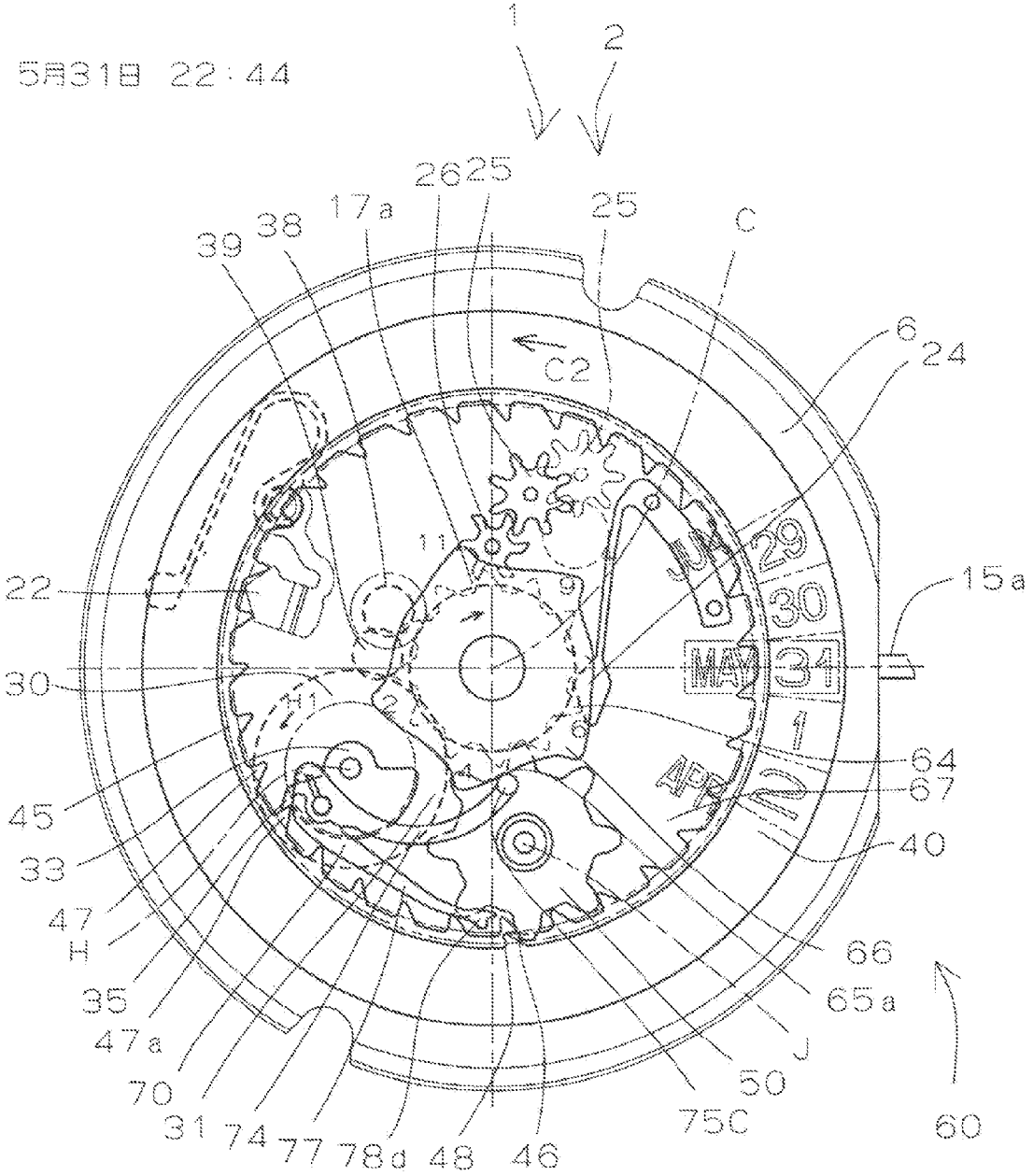
FIG. 20 is an explanatory plan view of the calendar mechanism of FIG. 1 showing it as indicating around 44 minutes past 10 o'clock p.m. on May 31.

After this, the gear portion 31 of the date indicator driving wheel 30 is rotated in the direction H1 in response to the rotation of the intermediate date wheels 38 and 39 as a result of the rotation of the hour gear 17*a* with the passage of time; around 44 minutes past 10 o'clock on May 31, the main body portion 35 of the date finger 33 is engaged with the closest tooth portion 47*a* of the date indicator 40; and, after this, date feeding is started. This state is substantially the same as the state of FIG. 6 shoving the timepiece as indicating around 44 minuses past 10 o'clock p.m. on April 30 except that it is not the end of a short month but that of a long month that is shown. FIG. 20 shows the timepiece as indicating the end of a long month (which, in this example, is May) (i.e., the end of the 31$^{st}$ day), so that the date indicator 40 is in advance by one day as compared with the state of FIG. 6; the month feeding tooth 46 of the date indicator 40 is engaged with the tooth 52 of the month feeding intermediate wheel 50, and, after this, month feeding is also started. Further, the state of FIG. 20 is that of a long month, so that the cam follower portion 75*c* of the first lever portion 74 of the operating lever 70 is in contact with the long month cam surface portion 65*a* of the month cam 66; thus, the finger portion 78*d* of the second lever portion 77 of the operating lever 70 is spaced away from the mouth end tooth 48 of the date indicator 40.

Figure 21:
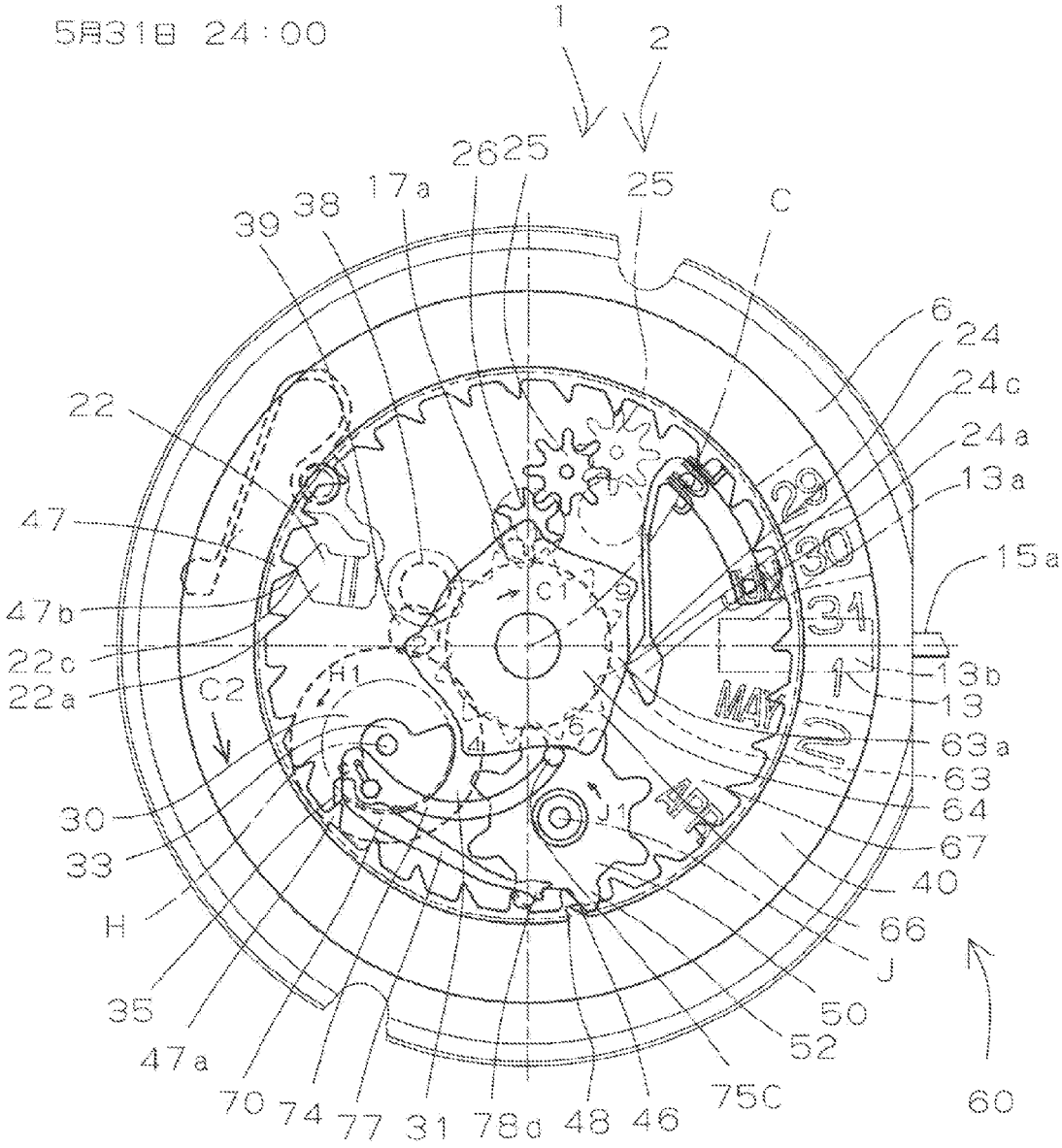
FIG. 21 is an explanatory plan view of the calendar mechanism of FIG. 1 showing it as indicating around 12 o'clock p.m. on May 31 (in the state in which the apexes of the jump control finger portions of the date jumper and the month jumper are engaged with the apex of a related tooth).

As shown in FIG. 21, when further time has elapsed to attain around 12 o'clock p.m. on May 31, the date feeding by the main body portion 35 of the date finger 33 and the month feeding by the month feeding finger portion 46 of the date indicator 40 proceed; and a state is attained in which the apex 22*c* of the lump control finger portion 22*a* of the date jumper 22 is engaged with the apex 47*b* of the tooth 47 of the gear portion 45 of the date indicator 40 and in which the apex 24*c* of the jump control finger portion 24*a* of the month jumper 24 is engaged with the apex 63*a* of the tooth 63 of the gear portion 64 of the month indicator 60, that is, a state in which date change and month chance are being proceeded; in the date display area 13*a* of the date display window 13, there is displayed an intermediate portion between "MAY" and "JUN," and, in the date display area 13, there is displayed an intermediate portion between "31" and "1." As stated above, the operating lever 70 is not operated for the date feeding at the end of a long month.

Figure 22:
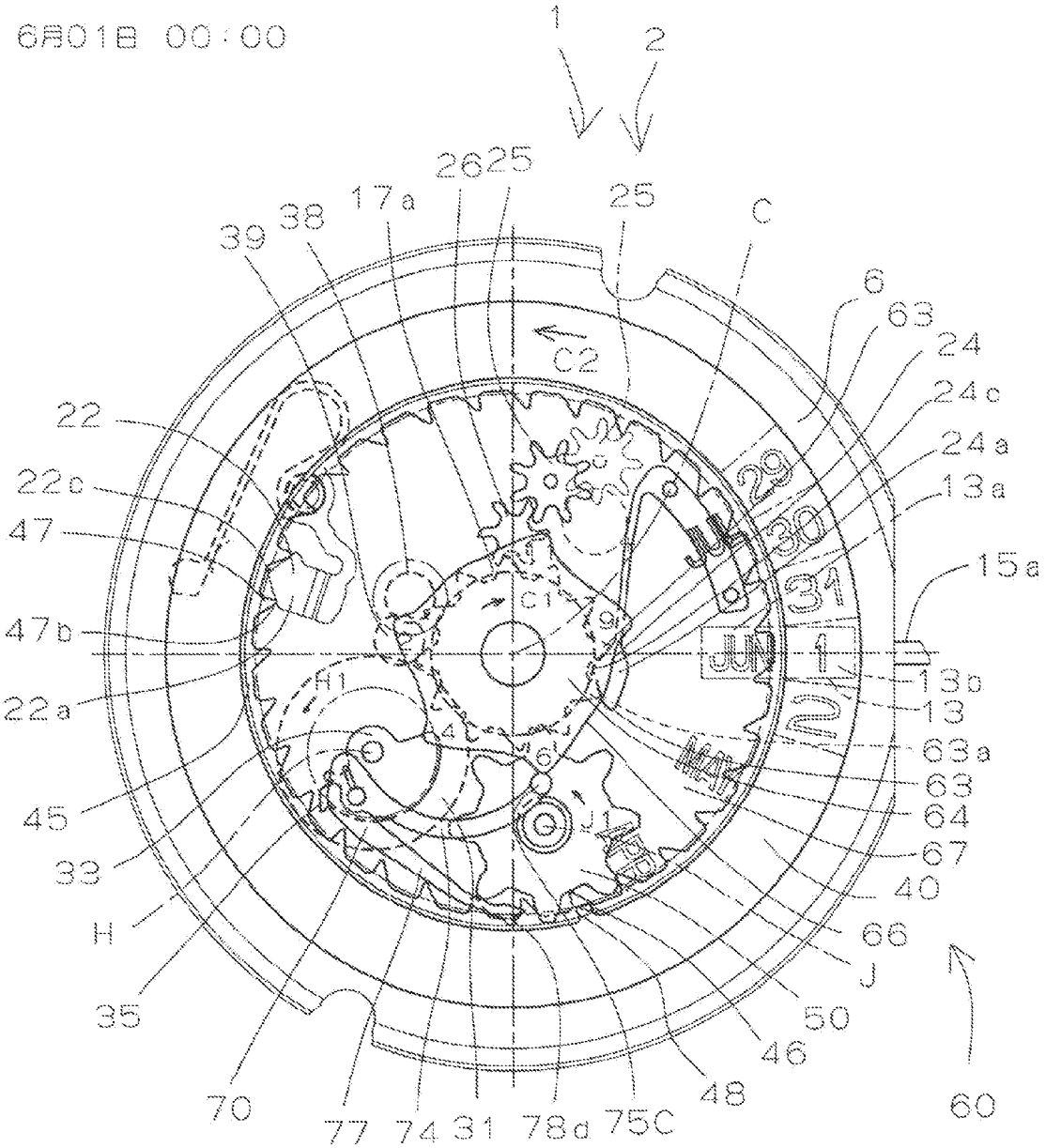
FIG. 22 is an explanatory plan view of the calendar mechanism of FIG. 1 showing it as indicating around 12 o'clock a.m. on June 1 (in the state in which the jump control finger portions of the date jumper and the month jumper have been completely dropped between adjacent related teeth).

As shown in FIG. 22, when, immediately after this, there is attained actually the same time, in other words, around 12 o'clock a.m. on June 1, the apex 22*c* of the jump control finger portion 22*a* of the date jumper 22 gets over the apex 47*b* of the tooth portion 47 of the date gear 45, and the jump control finger portion 22*a* drops between the adjacent tooth portions 47 to set the date gear 45 again; and the apex 24*c* of the jump control finger portion 24*a* of the month jumper 24 gets over the apex 63*a* of the tooth portion 63 of the month gear 64, and the jump control finger portion 24*a* drops between the adjacent tooth portions 63 to set the month gear 64 again, whereby the date change and the month change are completed. That is, "JUN" and "1" are displayed in the areas 13*a* and 13*b* of the date display window 13.

As shown in FIG. 23, when, some time has elapsed after this to attain, for example, around 6 o'clock a.m. on June 1, a date indicator driving gear 31 is rotated in the direction H1 via the intermediate date wheels 38 and 39 as a result of the rotation in the direction C1 of the hour gear 17*a*, and, in response to this rotation, the date finger 33 pressed by the date pin 32 is also rotated in the direction H1; and, at the same time, the operating lever 70, whose cam follower portion 75*c* at the distal end of the first lever portion 74 is in contact with the short month cam surface portion 65*b* of the cam surface 65 of the month cam 66, is caused to make relative rotation with respect to the offset rotation center shaft or offset pin 36 fit-engaged at the fit-engagement portion 72 of the proximal portion 71 in a friction-engaged state. In the state of FIG. 23, the offset pin 36 is situated on the 3 o'clock side (the right-hand side as seen in FIG. 23) of the rotation center axis H of the date indicator driving wheel 30, so that, as the date indicator driving wheel 40 rotates, the cam follower portion 75*c* of the operating lever 70 moves in the directions D1 and D2 along the short month cam surface portion 65*b*. At this time, the curved arm main body portion 75*e* of the first elastic arm portion 75 of the first lever portion 74 of the operating lever 70 is situated behind the month cam 66 as seen in FIG. 23 and partially overlaps the month cam 66. As stated above in relation to FIG. 3, the curved arm main body portion 75*e* is spaced apart from the month cam 66 and is situated on the case back side thereof (situated on the lower side as seen in FIG. 3), so that there is no tear of the curved arm main body portion 75*e* interfering with the month cam 66 to cause the movement of the curved arm main body portion the to be hindered by the month cam 66. In the state shown in FIG. 23, the date indicator 40 and the month indicator 60 are at the same positions as in FIG. 22 and remain motionless.

As shown in FIG. 24, when, further time has elapsed to attain, for example, around 36 minutes past 10 o'clock a.m. on June 1, the date indicator driving gear 31 is rotated in the direction H1 via the intermediate date wheels 38 and 89 as a result of the rotation in the direction C1 of the hour gear 17*a*, and, in response to this rotation, the date finger 33 pressed by the date pin 32 is also rotated in the direction H1; and, at the same time, the operating lever 70, whose cam follower portion 75*c* at the distal end of the first lever portion 74 is in contact with the short month cam surface portion 65*b* of the cam surface 65 of the men in cam 66, is caused to make relative rotation with respect to the offset rotation center shaft or offset pin 36 fit-engaged at the fit-engagement portion 72 of the proximal portion 71 in a friction-engaged state. In the state of FIG. 24, the offset pin 36 is situated beyond the phantom line connecting the rotation center axis H of the date indicator driving wheel 30 and the cam follower portion 75*c*, so that, as the date indicator driving wheel 40 rotates, the cam follower portion 75*c* of the operating lever 70 moves in the direction D2 toward the apex along the short month cam surface portion 65*b*. In this case, the curved arm main body portion 75*e* of the first elastic arm portion 75 of the first lever portion 74 of the operating lever 70 is situated behind the month cam 66 over a still larger range than in the case of FIG. 23 and partially overlaps the month cam 66. As stated above, the curved arm main body portion 75*e* is spaced apart from the month cam 66 and is situated, on the case back side thereof, so that there is no fear of the curved arm main body portion 75*e* interfering with the month cam 66 to cause the movement of the curved arm main body portion 75*e* to be hindered by the month cam 66. In the state shown in FIG. 24 also, the date indicator 40 and the month indicator 60 are at the same positions as in FIG. 23 and remain motionless.

After this, normal date feeding is performed, and when the end of a month is approached, for example, around 30 minutes past 3 o'clock on June 29, a state that is actually the same as that of FIG. 2 is attained since in both cases the time is near the end of a short month, the difference being solely that one is in June and the other in April; and, with the passage of time, similar date feeding and month feeding are effected.

As described above, in the calendar mechanism 1 according to a preferred embodiment of the present invention, "the proximal portion 71 of the operating lever structure 70 is friction-engaged with an offset shaft 36 offset with respect to the rotation center H of the date indicator driving wheel 30," so that the operating lever structure 70 rotates together with the date indicator driving wheel 40. Further, in the calendar mechanism 1, "the operating lever structure 70 is equipped with a first distal end portion constituting a cam follower 75*c* engaged with the month cam 66," so that the cam follower 75*c* is pressed against cam surface 65 of the month cam 66 when the operating lever structure 70 rotates together with the date indicator driving wheel 30. Further, in the calendar mechanism 1, "the proximal portion 71 of the operating lever structure 70 is friction-engaged with the offset shaft 36 of the date indicator driving wheel 40," so that when the cam follower 75*c* is pressed against the month cam 66, the operating lever structure 70 makes relative rotation with respect to the offset shaft 36. Further, in the calendar mechanism 1, "the operating lever structure 70 is equipped with a second distal end portion 78*d* with the month end tooth 48 of the date indicator 40 to effect additional date feeding by one day with respect to the date indicator 40 at the end of a short month," so that, at the end of a short, month, the proximal portion 71 of the operating lever structure 70 whose proximal portion 71 is friction-engaged with the offset shaft 36 and whose first distal end portion constituting a cam follower 75*c* is pressed against the month cam 66, makes relative rotation with respect to the offset shaft 36 under the control of the month cam 66, and, while doing so, the second distal end portion thereof constituting a short month end feeding finger 78*d* is engaged with the month end tooth 48 of the date indicator 40 to perform additional date feeding by one tooth with respect to the date indicator 40. In other words, in the calendar mechanism 1, at the end of a long month, the month cam 66 sets in position or displaces the operating lever structure 70 via the cam follower 75*c* of the operating lever structure 70 in order to relieve the short month end feeding finger 49 so that the second distal end per tics, in the form of a short month end feeding finger 78*d* of the operating lever structure 70 may not be engaged with the month end tooth 48 of the date indicator 40. Accordingly, in the calendar mechanism 1, it is only necessary to provide the date indicator driving wheel 30 with the operating lever structure 70 and to perform additional date feeding by one day with respect to the date indicator 40 at the end of a short month, so that it is possible to avoid an excessively complicated structure; further, it is only necessary for the frictional load between the operating lever structure 70 and the offset shaft 36 to be large enough to cause the operating lever structure 70 to rotate together with the date indicator driving wheel 30, so that it is possible to prevent the frictional load from being increased to an excessive degree.

As described above, in the calendar mechanism 1, "the date indicator driving wheel 30 is equipped with a date gear portion 31 in the form of a disc-like date indicator driving wheel main body adapted to make one rotation every 24 hours, a date pin 32 provided so as to be erected at the offset position of the date indicator driving wheel main body 31, and a date finger 33 provided coaxially with respect to the date indicator driving wheel main body 31 so as to be capable of making relative rotation with respect to the date indicator driving wheel main body 31 and adapted to be rotated by the date pin 32, with the date finger 33 being equipped with the offset shaft 36 friction-engaged with the proximal portion 71 of the operating lever structure 70," so that the date finger 33 is actually formed as a rigid member, and the proximal portion 71 of the operating lever structure 70 is friction-engaged with the offset, shaft 36 of the date finger 33.

Further, in the calendar mechanism 1, "the operating lever structure 70 is integrally equipped with a first lever portion 74 connecting the proximal portion 71 and the first distal end portion 75*c*, and a second lever portion 77 connecting the proximal portion 71 and the second distal end portion 78*d*; the second lever portion 77 is capable of elastic deformation, and the month end tooth 48 causes the second lever portion 77 to undergo elastic deformation with the jump control of the dare indicator 40 at the end of a short month, thus leaving behind the distal end portion 78*d* of the second lever portion 77," so that, at the time of jump control of the date indicator 40 at the end of a short month, that is, at the time of completion of the jump control of the data jumper 22 at the end of normal date feeding at the end of a short month, the month end tooth 48 causes the second lever portion 77 to undergo elastic deformation to enable it to be situated so as to leave behind the distal end portion 78*d* of the second lever portion 77, and she month end tooth 48 at the leave-behind position is again engaged with the distal end portion (the second distal end portion) 78*d* of the second lever portion 77 in several hours, thus making it possible to effect additional, date feeding by the second distal end portion 78*d*.

Further, in the calendar mechanism 1, "the first distal end portion consists of a pin-like cam follower portion 75*c* erected at the distal end of the first lever portion 74; the pin-like cam follower portion 75*c* abuts the cam surface 65 of the month cam 66; and the month cam 66 consists of a plate-like member, with the portion of the first lever portion 74 other than the pin-like cam follower portion 75*o* being capable of overlapping the month cam 66 in the form of a plate-like member in a non-interference state," so that the rotation center of the date indicator driving wheel 30 can assume a position in close proximity to the outer peripheral surface of the month cam 66, making it possible to minimize the size in plan view.

Further, in the calendar mechanism 1, "the month end tooth 48 of the date indicator 40 and the month feeding tooth 46 engaged with a month feeding intermediate wheel 50 rotating a month star 64 concentric with the month cam 66 to rotate the month feeding intermediate wheel 50, are provided at different positions in the thickness direction of the date indicator 40 at the same position or positions in close proximity to each other as seen in the peripheral direction C1, C2 of the date indicator 40," so that it is possible to minimise the occupation space. In this case, there are typically provided the month end tooth and the month feeding tooth.

Further, in the calendar mechanism 1, "the cam surface 65 of the month cam 66 is continuous and is curved smoothly over the entire area thereof," so that the degree of freedom, in terms of the movement of the portion constituting the cam follower 75*c* can be maximised, and it is possible to suppress the size in plan view of the mechanism to a minimum degree.

What is claimed is:

1. A calendar mechanism comprising:

a month cam equipped with a cam surface distinguishing between a long month having 31 days and a short month having 30 days or less and adapted to make one rotation a year;

a date indicator equipped with a date wheel and a month end tooth;

a date indicator driving wheel equipped with a date finger adapted to make one rotation every 24 hours and engaged with the date wheel of the date indicator to rotate the date indicator; and an operating lever structure whose proximal portion is friction-engaged with an offset shaft so as to be capable of rotating around the offset shaft offset with respect to the rotation center of the date indicator driving wheel and which is equipped with a first distal end portion constituting a cam follower engaged with the month cam and a second distal end portion constituting a short month end feeding finger engaged with the month end tooth of the date indicator to effect additional date feeding by one day with respect to the date indicator at the end of a short month.

2. The calendar mechanism according to claim 1, wherein the date indicator driving wheel is equipped with a disc-like date indicator driving wheel main body adapted to make one rotation every 24 hours, a date pin provided so as to be erect at the offset position of the date indicator driving wheel main body, and a date finger provided coaxially with respect to the date indicator driving wheel main body so as to be capable of making relative rotation with respect to the date indicator driving wheel main body and adapted to be rotated by the date pin, with the date finger being equipped with the offset shaft friction-engaged with the proximal portion of the operating lever structure.

3. The calendar mechanism according to claim 1, wherein the operating lever structure is integrally equipped with a first lever portion connecting the proximal portion and the first distal end portion, and a second lever portion connecting the proximal portion and the second distal end portion.

4. The calendar mechanism according to claim 3, wherein the second lever portion is capable of elastic deformation.

5. The calendar mechanism according to claim 3, wherein the first distal end portion consists of a pin-like cam follower portion erected at the distal end of the first lever portion; the pin-like cam follower portion abuts the cam surface of the month cam; and the month cam consists of a plate-like member, with the portion of the first lever portion other than the pin-like cam follower portion being capable of overlapping the month cam in the form of a plate-like member in a non-interference state.

6. The calendar mechanism according to claim 1, wherein the month end tooth of the date indicator and the month feeding tooth engaged with a month feeding intermediate wheel rotating a month star concentric with the month cam to rotate the month feeding intermediate wheel, are provided at the same position or positions in close proximity to each other as seen in the peripheral direction of the date indicator.

7. The calendar mechanism according to claim 1, wherein the cam surface of the month cam is continuous and is curved smoothly over the entire area thereof.

8. A timepiece having a calendar mechanism as claimed in claim 1.

* * * * *